US006517263B1

(12) United States Patent
Piccinino, Jr. et al.

(10) Patent No.: US 6,517,263 B1
(45) Date of Patent: Feb. 11, 2003

(54) PHOTOGRAPHIC PROCESSOR HAVING SIDE BY SIDE PROCESSING PATHS AND METHOD OF OPERATION

(75) Inventors: Ralph L. Piccinino, Jr., Rush, NY (US); Daniel M. Pagano, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/108,141

(22) Filed: Mar. 27, 2002

(51) Int. Cl.[7] ..... G03D 3/04; G03D 3/08

(52) U.S. Cl. ..... 396/625; 396/634; 396/635; 396/617

(58) Field of Search ..... 396/548, 612, 396/617, 620, 625, 633, 634, 635, 636, 641; 355/27–29; 134/64 R, 64 P, 122 P, 122 R

(56) References Cited

U.S. PATENT DOCUMENTS

| | | | | | |
|---|---|---|---|---|---|
| 3,792,651 | A | * | 2/1974 | Banks | 396/635 |
| 4,005,463 | A | * | 1/1977 | Kowalski | 396/634 |
| 4,269,501 | A | * | 5/1981 | Griffith et al. | 396/625 |
| 4,277,159 | A | * | 7/1981 | Descotes | 396/635 |

* cited by examiner

*Primary Examiner*—D. Rutledge
(74) *Attorney, Agent, or Firm*—David A. Novais

(57) ABSTRACT

A photographic processor and method of operation is disclosed. The processor includes a circular drum having first and second film processing paths, and a disk positioned inside the drum. The disk comprises a first set of disk teeth for engagement with perforations on a first type of film and a second set of disk teeth for engagement with perforations on a second type of film. The first and second set of disk teeth are positioned along a portion of an outer periphery of the disk. The processor also includes a circular dryer for drying the processed film. The dryer extends around an outer periphery of the drum.

19 Claims, 25 Drawing Sheets

PHOTOGRAPHIC PROCESSOR HAVING SIDE BY SIDE PROCESSING PATHS AND METHOD OF OPERATION

CROSS REFERENCE TO RELATED APPLICATIONS

The present application is related to the following pending patent applications, some of which are filed concurrently herewith: U.S. patent application Ser. No. 10/027,382 filed Dec. 21, 2001, entitled PHOTOGRAPHIC PROCESSOR AND METHOD OF OPERATION and U.S. patent application Ser. No. 10/027,381 filed Dec. 21, 2001, entitled PHOTOGRAPHIC PROCESSOR HAVING AN ADJUSTABLE DRUM.

FIELD OF THE INVENTION

The present invention is directed to a photographic processor and method of operation.

BACKGROUND OF THE INVENTION

Photographic processors come in a variety of shapes and sizes from large wholesale photographic processors to small micro-labs. As photographic processors become more and more technologically sophisticated, there is a continued need to make the photographic processor as user-friendly and as maintenance-free as possible.

Currently available photographic processors have one or more of the following shortcomings: (1) the film processing time is relatively high; (2) some photographic processors, because of their size, require a large amount of space; (3) some photographic processors may require an unacceptable amount of developing solution due to the design of the processing tank; and (4) some photographic processor generate an unacceptable amount of developing solution waste due to the design of the processing tank.

What is needed in the art is a photographic processor, which provides exceptional print quality while requiring a minimal number of tasks necessary for an operator to process a roll of film. What is also needed in the art is a photographic processor, which is designed to efficiently process a roll of film while minimizing the amount of waste generated during the photographic process.

SUMMARY OF THE INVENTION

The present invention addresses some of the difficulties and problems discussed above by the discovery of a novel and compact photographic processor having an internal drum design, which minimizes the chemicals required to process a roll of film and consequently minimizes the amount of waste generated per roll of film processing. The photographic processor is extremely user-friendly and low maintenance.

Accordingly, the present invention is directed to a photographic processor and a method of processing film using the photographic processor. The present invention is further directed to photographic processor which can process various types of film.

The present invention relates to a photographic processor that comprises a processing drum having a first wall, a second wall and a side wall connecting the first wall to the second wall, with the side wall extending around a perimeter of the drum; a disk positioned inside the drum in a plane parallel to both the first wall and the second wall, wherein the disk comprises a first set of disk teeth capable of interengaging with first holes along an edge of a first type of film and a second set of disk teeth capable of interengaging with second holes along an edge of a second type of film; and a mechanism for rotating the disk.

The present invention further relates to a processing device that comprises a means for processing a first type of film along a first circular processing path and processing a second type of film along a second circular processing path, wherein the first and second circular processing paths are respectively positioned within adjacent parallel planes; and means for conveying the first and second types of film along the first and second circular processing paths.

The present invention further relates to a processing apparatus that comprises a circular processing drum having a first film path for processing a first type of film and a second film path for processing a second type of film, with the first and second film paths being respectively positioned in parallel planes; and a circular disk positioned inside the drum. The disk comprises a first set of disk teeth capable of interengaging with first holes on the first type of film to convey the first type of film along the first film path, and a second set of disk teeth capable interengaging with second holes on the second type of film to convey the second type of film along the second path.

The present invention further relates to a method of processing photographic film which comprises the steps of inserting the film into a first processing path or a second processing path of a circular processing drum based on a type of film to be processed, with the first processing path being adapted to receive a first type of film and the second processing path being adapted to receive a second type of film which is different than the first type of film; supplying and discharging processing solution into and from the processing drum to process the film; and transferring the processed film from the circular processing drum to a circular drying cylinder.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION OF THE INVENTION

Figure 1:
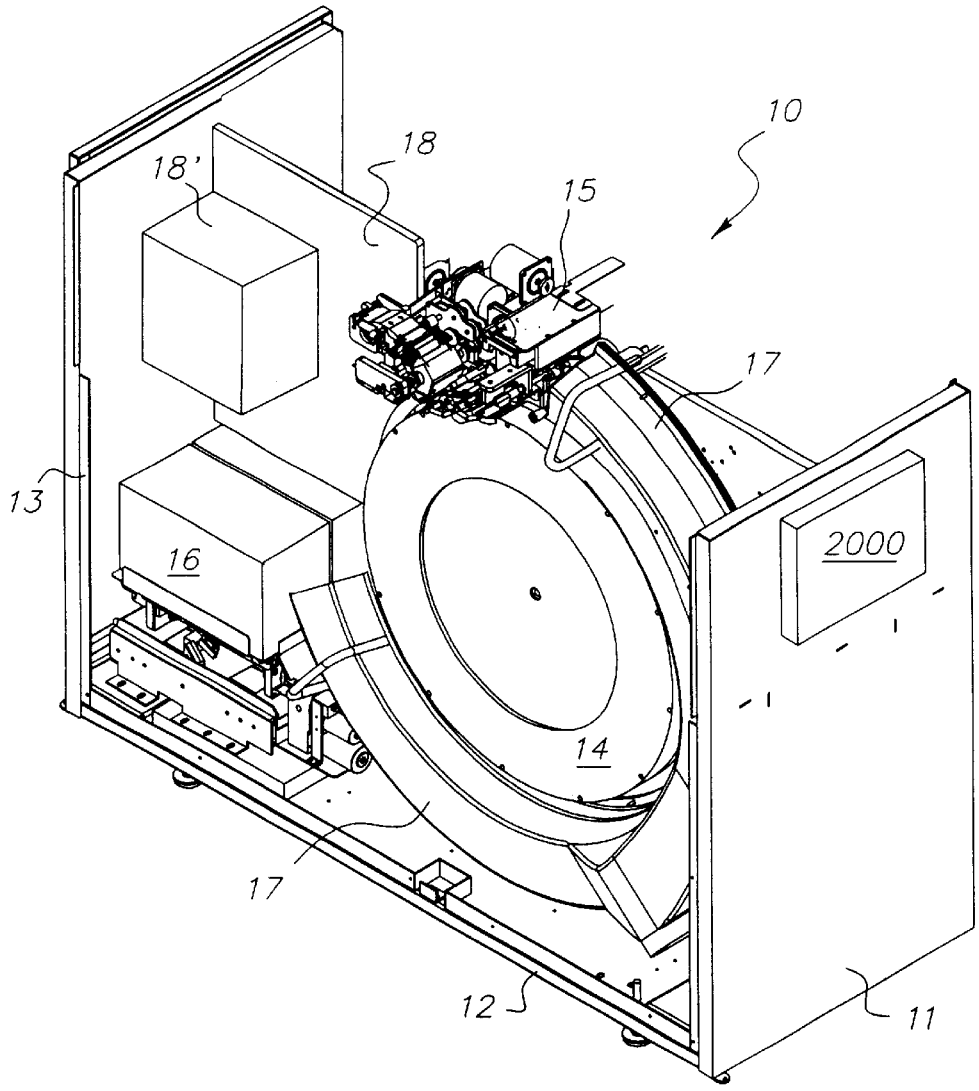
FIG. 1 is a frontal view of an exemplary photographic processor of the present invention.

The present invention is directed to photographic processors. An exemplary photographic processor of the present invention is shown in FIG. 1. The photographic processor 10 comprises at least an outer housing, which includes a first side wall 11, a base housing member 12, and second side wall 13. The photographic processor 10 includes a circular processing chamber 14 (also referred to herein as the "circular processing drum 14"), which may be used to expose a given strip or roll of film to one or more photoprocessing chemicals. Photographic processor 10 further includes a film-loading/unloading device 15 positioned above and cooperating with circular processing drum 14. A chemical delivery system 16 is positioned for easy access by a user (i.e., for maintenance or replacement purposes) at a location near side wall 13 and base housing member 12. Photographic processor 10 also includes a circular dryer 17 in the form of, for example, a cylinder, for drying the processed film. Dryer 17 is concentrically and co-axially positioned around processing drum 14. Once a given strip or roll of film is dried in dryer 17, the film proceeds to a scanner 18', which may be positioned above chemical delivery system 16 in a space bordered by side wall 13 and left interior wall 18 or any other convenient location.

Figure 2:
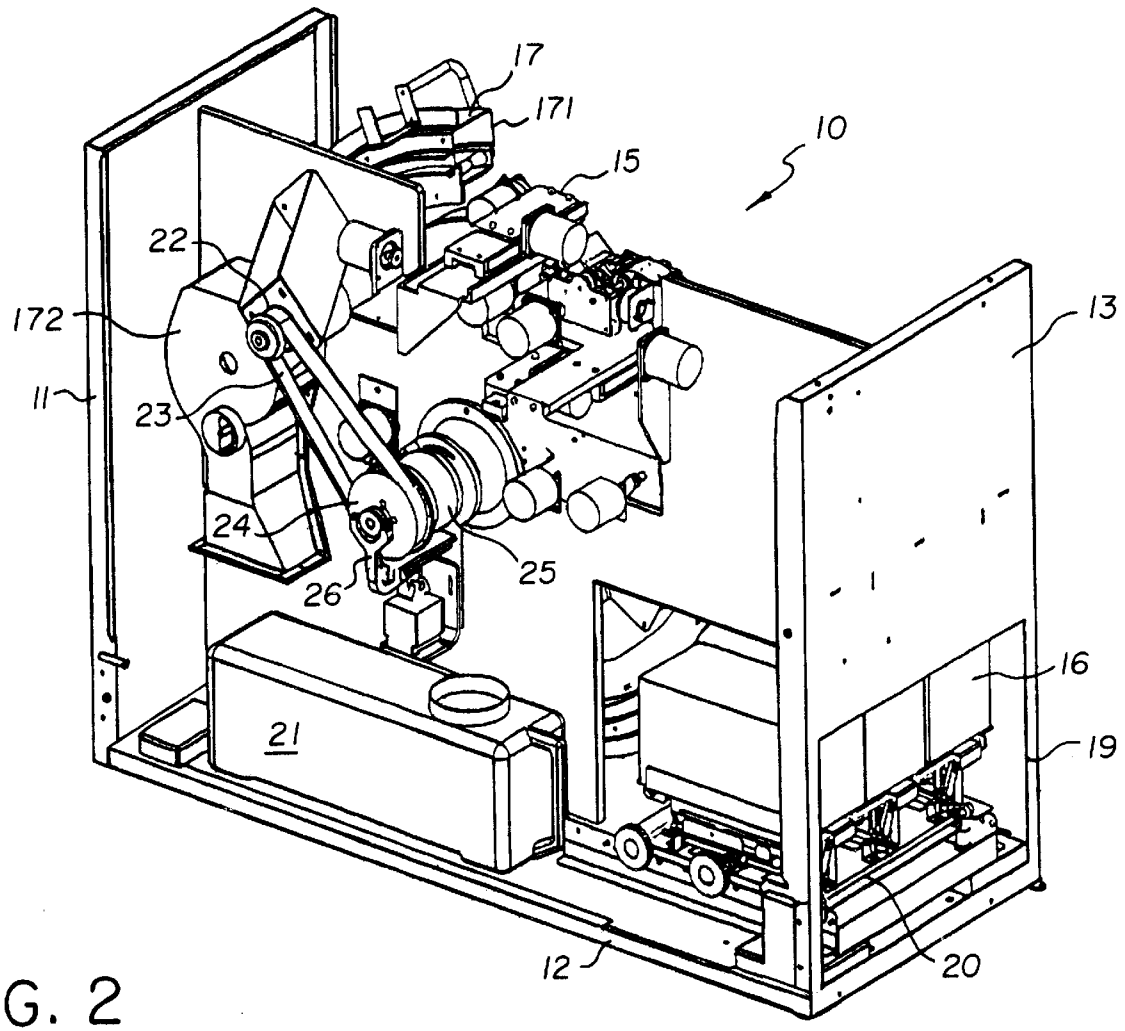
FIG. 2 is a rear view of an exemplary photographic processor of the present invention.

FIG. 2 depicts a rear view of photographic processor 10. As shown in FIG. 2, photographic processor 10 includes opening 19 in side wall 13 for accessing chemical delivery system 16. Sliding track mechanism 20 allows an operator to pull at least a portion of chemical delivery system 16 through opening 19 to an exterior location outside of photographic processor 10. Such an assembly allows for quick and easy maintenance and replacement of chemical delivery system 16. Photographic processor 10 can include a waste collection reservoir 21, which collects and stores used processing chemicals removed from circular processing drum 14 following development of a given strip or roll of film. As shown in FIG. 2, dryer 17 includes dryer entrance 171 and dryer blower 172. The various components of photographic processor 10 will be described in more detail below with reference to FIGS. 3–21.

Figure 3:
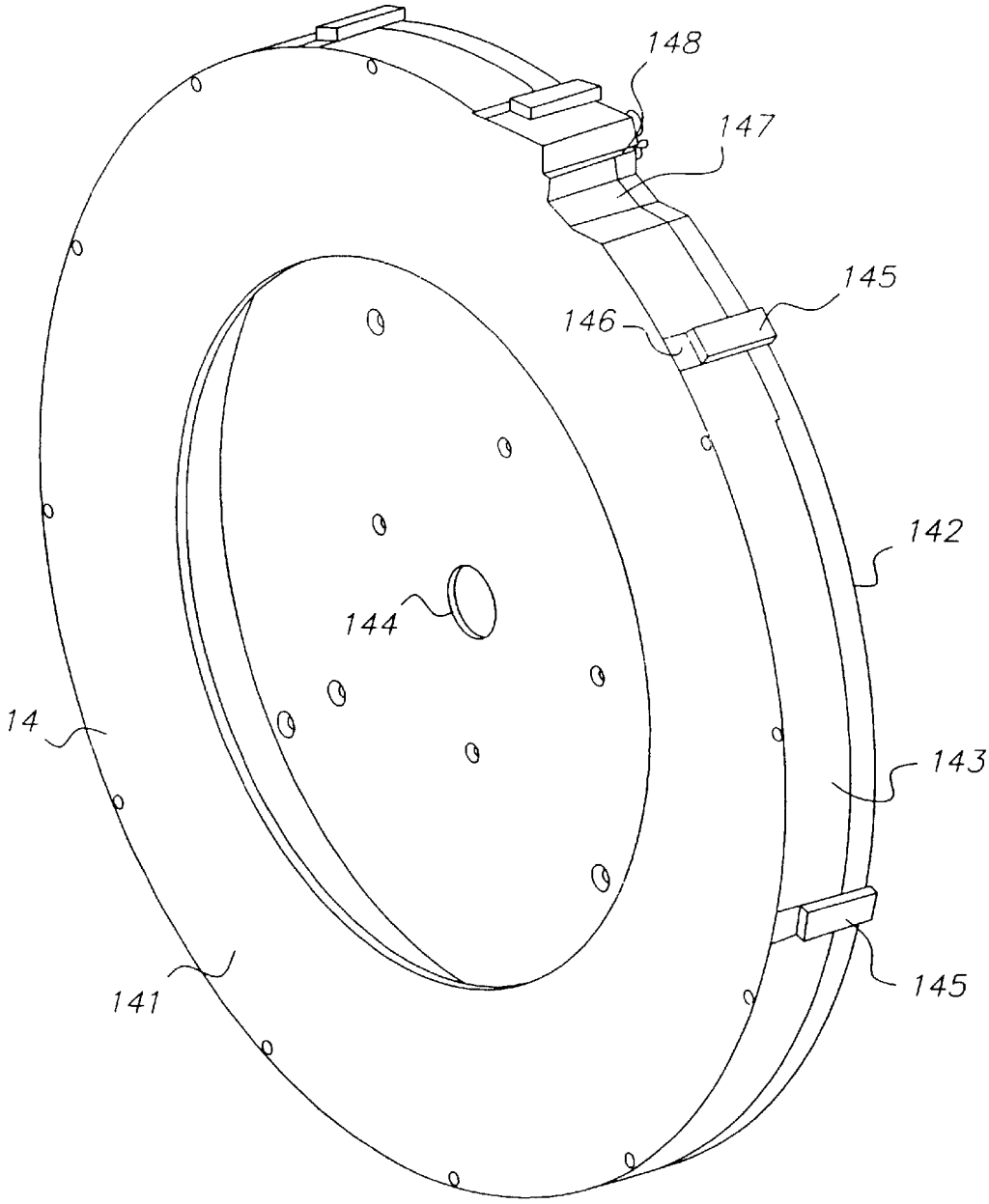
FIG. 3 depicts exemplary circular processing drum used in the photographic processor of the present invention.

Circular processing drum 14 is further described in FIG. 3. As shown in FIG. 3, circular processing drum 14 includes a first wall 141, a second wall 142, a side wall 143, and a central axis opening 144. A portion of a drum and disk drive mechanism 25 (shown in FIGS. 2, 8 and 9) passes through central access opening 144. Circular processing drum 14 comprises two circular sections joined together at multiple locations around the perimeter of circular processing drum 14 via male clasping members 145 and female clasping members 146. It should be noted that any means for attaching the two circular components of circular processing drum 14 may be used in place of male clasping members 145 and female clasping members 146. Further, it should be noted that circular processing drum 14 may also consist of a single component as oppose to two circular components as shown in FIG. 3, although such a design may add manufacturing cost to circular processing drum 14. Circular processing drum 14 further comprises a film cartridge loading area 147 on an outer surface of side wall 143 for loading film directly from a film cartridge into circular processing drum 14, such as with APS film. Circular processing drum 14 also comprises a film input slot 148, which enables the entry and exit of film into circular processing drum 14.

Figure 4:
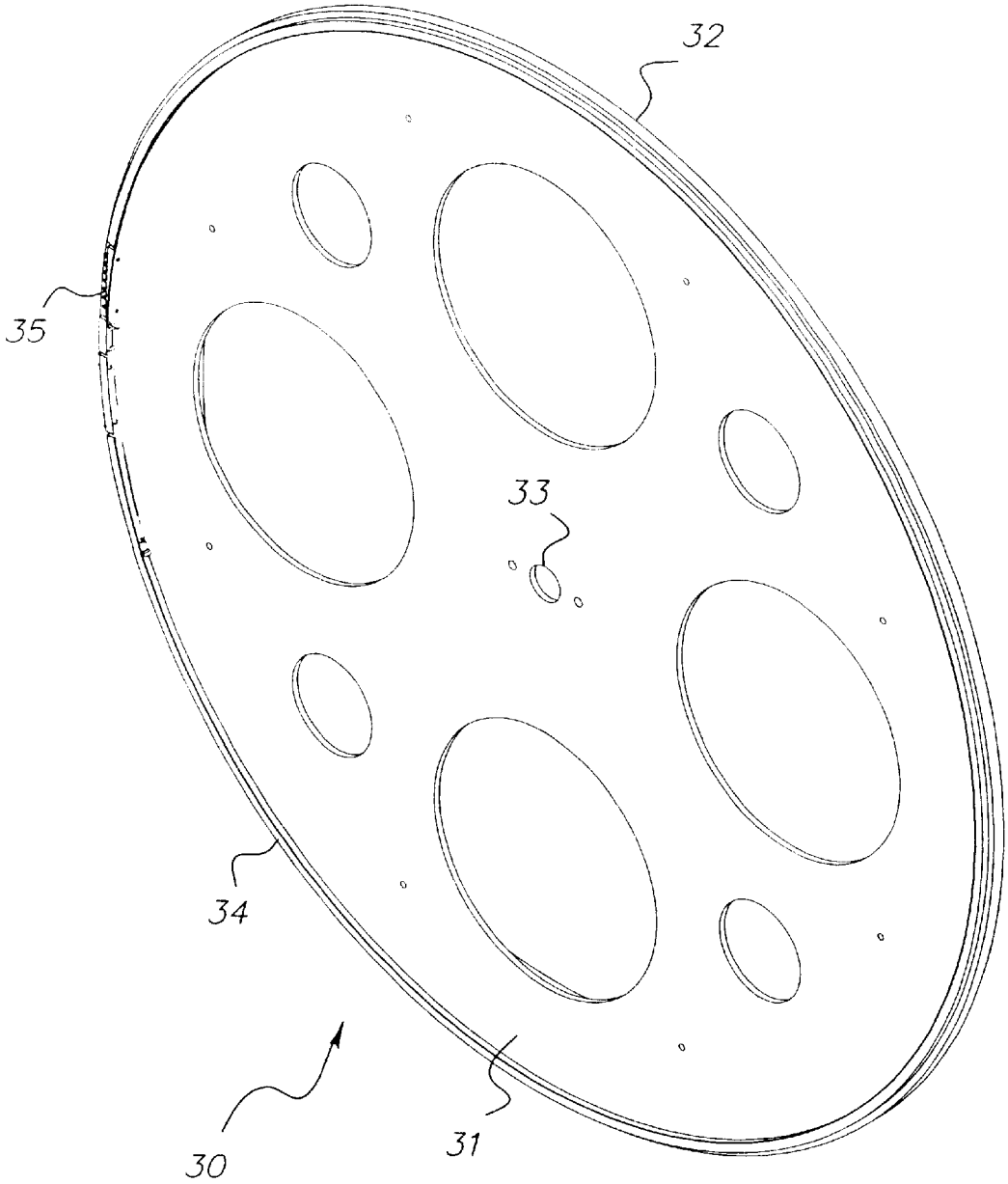
FIG. 4 depicts an exemplary disk located within the circular processing drum of the present invention.
Figure 5:
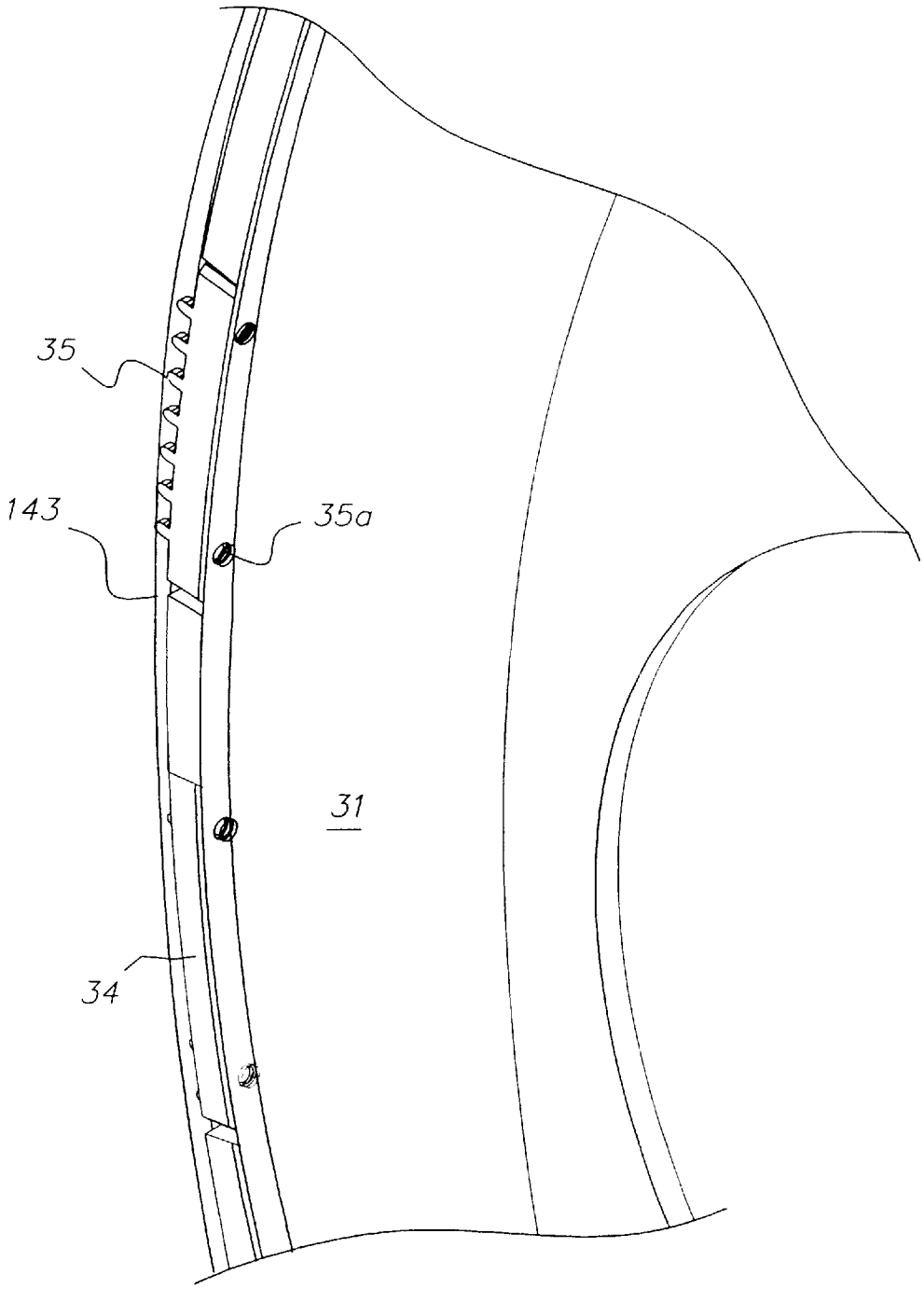
FIG. 5 displays a close-up view of an exemplary disk having an outer perimeter and one more sets of disk teeth.
Figure 6:
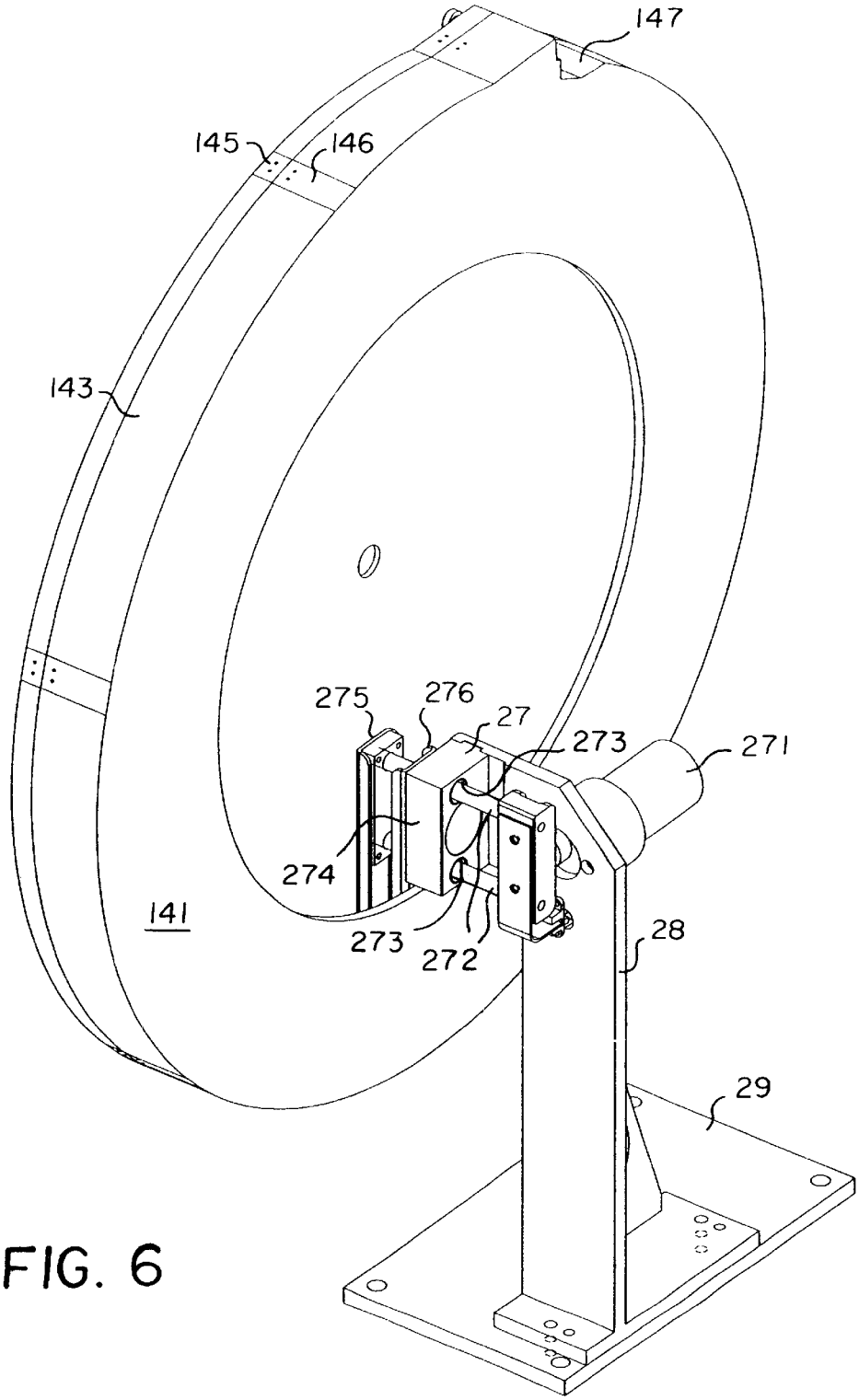
FIG. 6 depicts an exemplary roller mechanism positioned within the circular processing drum.

FIG. 4 depicts an exemplary disk 30, which is positioned within circular processing drum 14, and functions to convey film within circular processing drum 14 once the film enters through film input slot 148. Disk 30 includes a first face 31, a second face 32, a central access opening 33, an outer perimeter 34, and one or more sets of disk teeth 35 located along outer perimeter 34 of disk 30. As with circular processing drum 14, a portion of drum and disk drive mechanism 25 may extend into central access opening 33 to engage with and cause rotation of disk 30. FIG. 5 provides a close-up view of a portion of disk 30, and in particular, outer perimeter 34 and a set of disk teeth 35 on the outer perimeter 34 of disk 30. The outermost points of disk teeth 35 are in close proximity to an inner surface of side wall 143 of circular processing drum 14. In a feature of the invention, disk teeth 35 could be spring loaded through the use of springs 35*a*.

Figure 7:
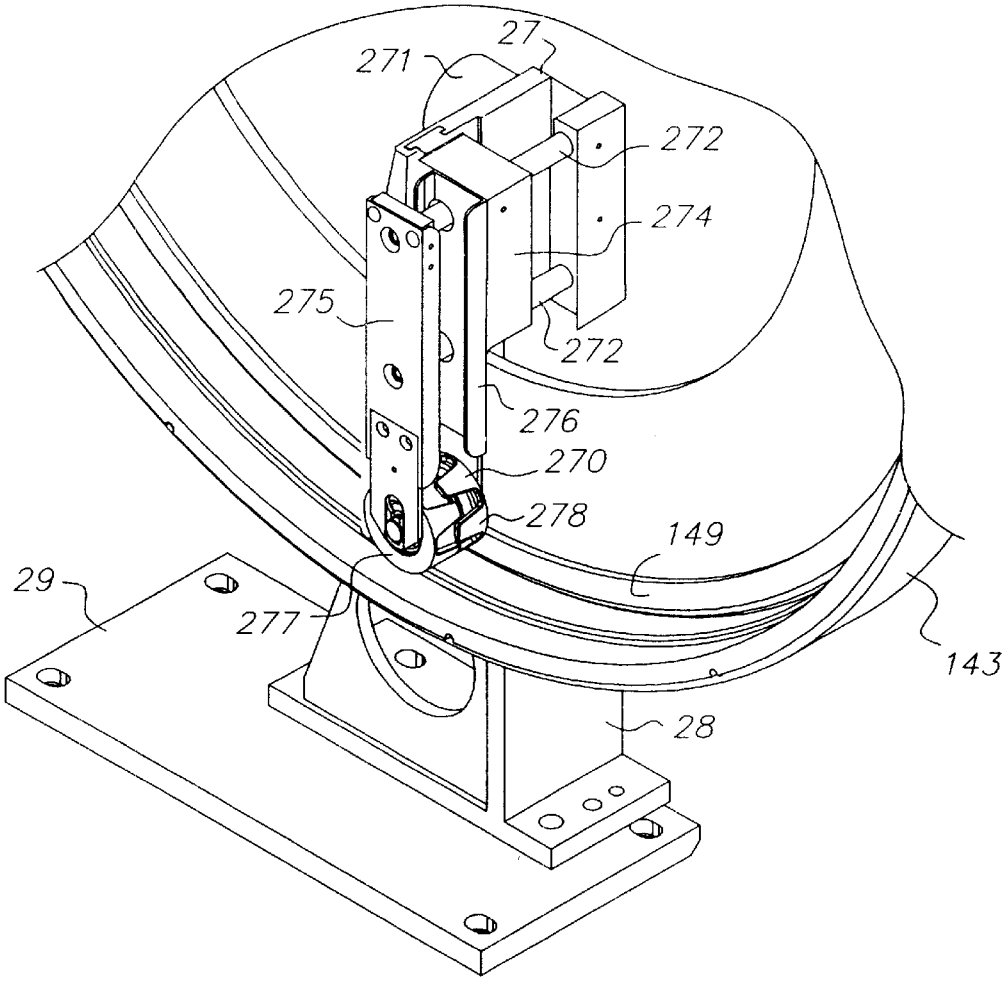
FIG. 7 depicts a rear view of the exemplary roller mechanism of FIG. 6.

In one feature of the present invention, a roller arrangement 27 (FIGS. 6 and 7) is positioned within circular processing drum 14. Roller arrangement 27 includes a roller 270 having interengaging members 277 and 278 (FIG. 7). Roller arrangement 27 may be supported by a support member 28, which is attached to a support member base 29. Support member base 29 may be permanently or temporarily attached to base housing member 12 (shown in FIGS. 1 and 2). Roller arrangement 27 includes a motor 271, which provides motion to pistons 272 through openings 273 in a fixed positioning member 274. Pistons 272 proceed through stationary positioning support member 276 and are attached to movable positioning support member 275. As pistons 272 move, movable positioning support member 275 which is coupled to member 277 separates from stationary positioning support member 276 which is coupled to member 278. This permits roller 270 to be expandible between a first width when the members 277 and 278 overlap each other and a second width larger than the first width (FIG. 7) when the members 277 and 278 move away from each other.

FIG. 7 provides a detailed view of roller arrangement 27 and its various components. As shown in FIG. 7, movable positioning support member 275 and stationary positioning support member 276 connect to interengaging members 277 and 278 respectively as described above. During use, the film passes between roller 270 and an interior surface of drum 14. Roller 270 is freely rotatable and maintains the film flat along the lower portion of drum 14. As will be described later, roller 270 further provides an agitating feature within processing drum 14 during processing. Additionally, the width of roller 270 is adjustable as described above to accommodate a shorter width film (i.e. APS film) and a larger width film (i.e. 35 mm film). Further, roller arrangement 27 including roller 270 can be vertically adjustable to accommodate for film curl as the film passes between roller 270 and the interior surface of drum 14. As a still further option, roller 270 can be spring loaded so as to accommodate any variation in the interior surface of drum 14.

Figure 8:
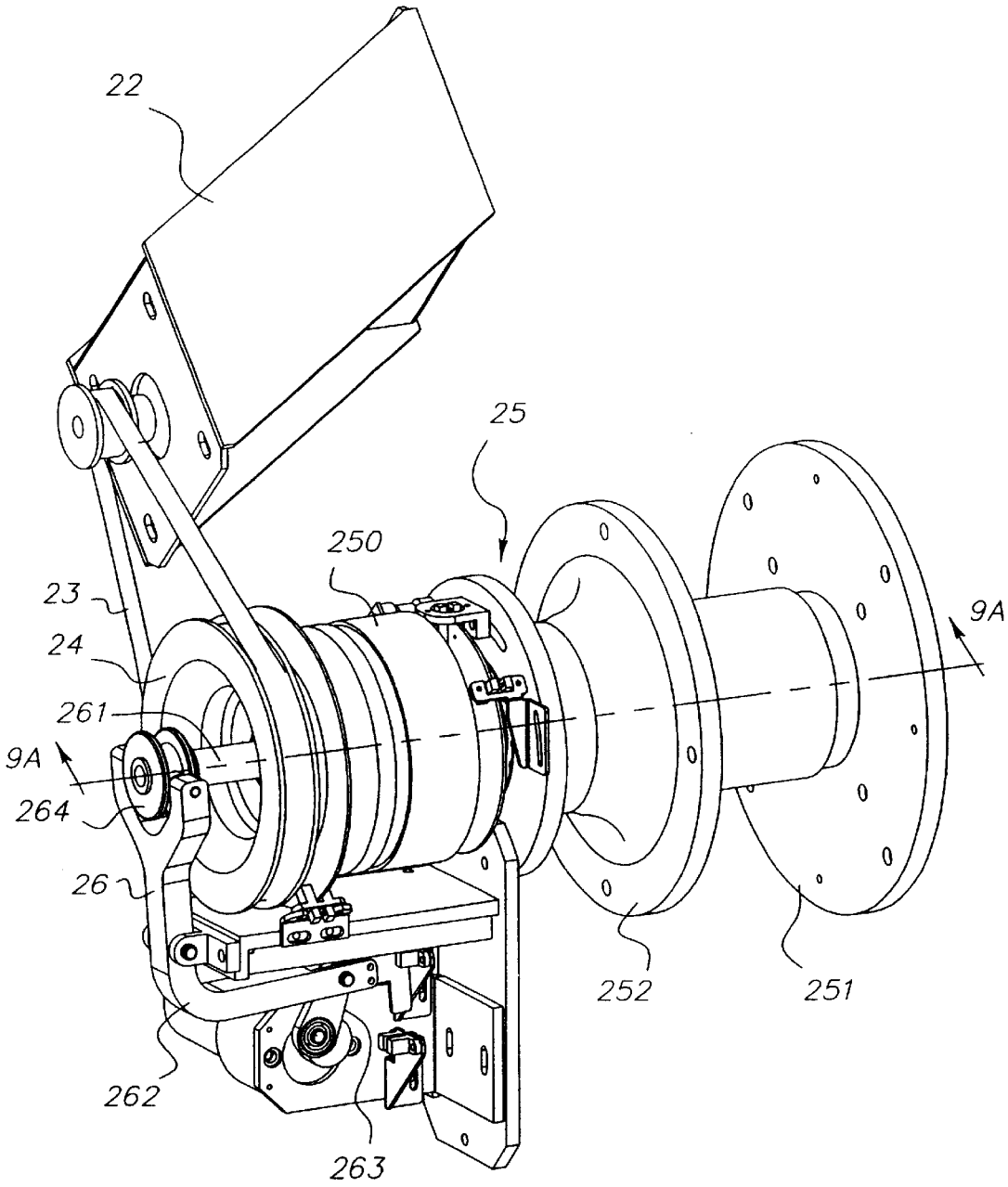
FIG. 8 depicts an exemplary drum and disk drive mechanism for rotating a circular processing drum, and a clutch mechanism for selectively engaging the drum and disk.
Figure 9A:
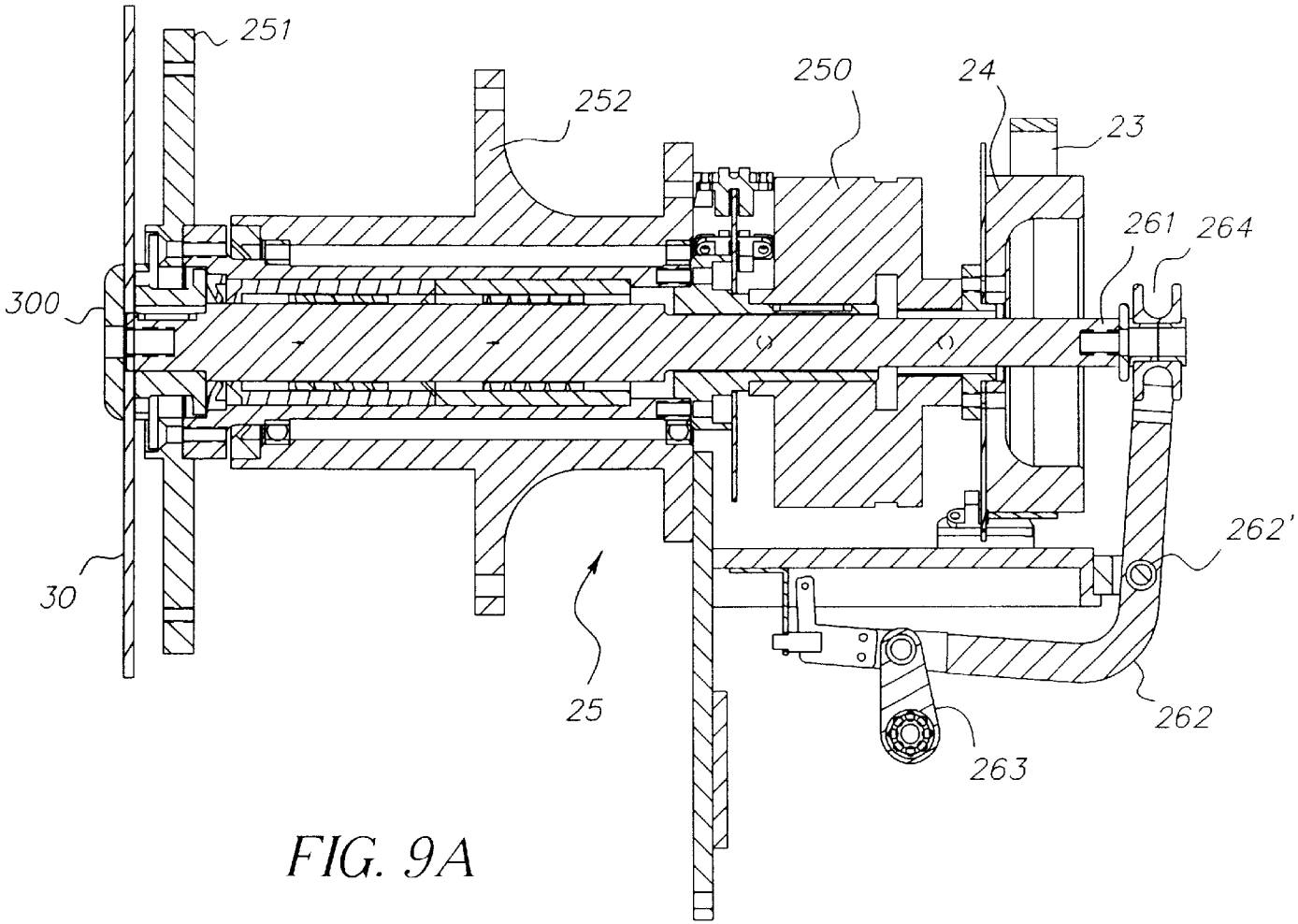
FIG. 9 displays a cross-sectional view of the drum and disk drive mechanism along line 9A—9A in FIG. 8.
FIG. 9B schematically illustrates a driving and clutching arrangement of the invention.

In a further embodiment of the present invention, circular processing drum 14 is connected to a drum and disk drive mechanism 25, which selectively rotates disk 30 relative to drum 14 to position and convey the film along and within processing drum 14, and rotates both disk 30 and drum 14 together during a processing cycle. Circular processing drum 14 rotates about an axis of symmetry. An exemplary drum and disk drive mechanism 25 is shown in FIG. 8. Drum and disk drive mechanism 25 cooperates with a motor 22, a belt 23, and a pulley 24 as shown in FIGS. 8 and 9A. Drum and disk drive mechanism 25 includes a drive shaft 261 which is operationally connected to pulley 24. Also shown in FIGS. 8 and 9A are flanges 251 and 252. Flange 251 is connected to drum 14 while an end cap 300 holds disk 30 for rotation about drive shaft 261 (FIG. 9A). Actuation of motor 22 drives belt 23 which in turn drives pulley 24. This in turn causes a rotation of drive shaft 261 which rotates disk 30. Clutch mechanism 250 enables the engagement and disengagement of flange 251 to provide selective rotation to circular processing drum 14.

Figure 9B:
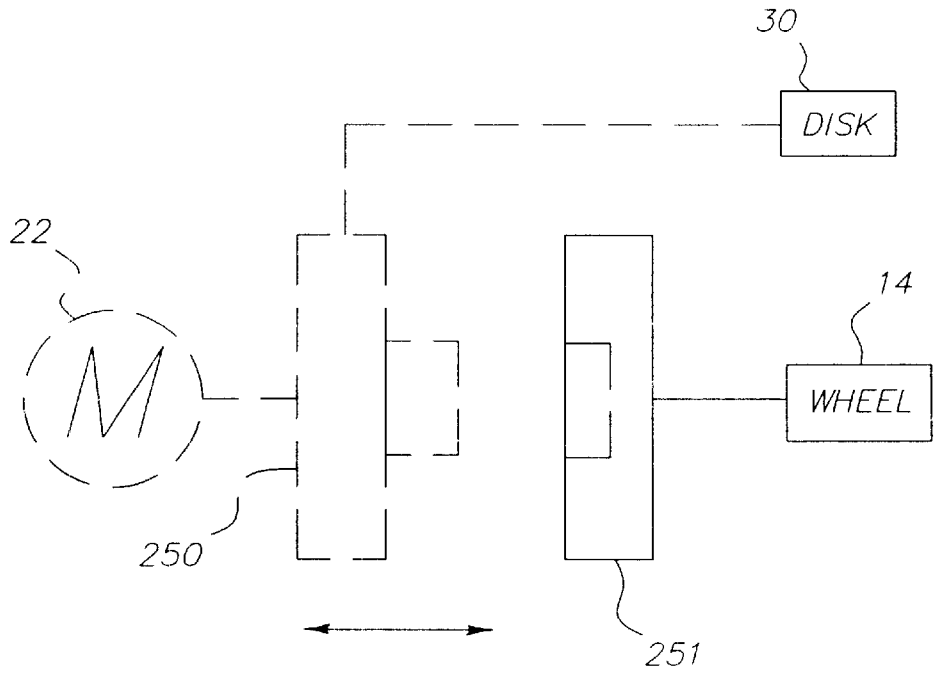

FIG. 9A displays a cross-sectional view of drum and disk drive mechanism 25 and clutch mechanism 250 along line 9A—9A in FIG. 8. With reference to FIG. 9A and FIG. 9B which is a schematic representation of the driving and clutching feature of the present invention, an operation will now be described. When loading film which will be described with reference to FIGS. 10 and 11, clutch 250 is deactivated as shown in FIG. 9B. In this state, rotation of motor 22 will cause a rotation of drive shaft 261 and accordingly, a rotation of disk 30 relative to drum 14. This is due to the fact that clutch 250 is deactivated and therefore, drum 14 is not rotated. This permits the conveyance of the film by rotation of disk 30 to a desired location within drum 14. After the film reaches the desired location within drum 14, clutch 250 is activated, (for example, clutch 250 is moved to the right in FIG. 9B) by actuating clutch 250 with flange 251 which is attached to drum 14. Therefore, a rotation of motor 22 will cause a rotation of both disk 30 and drum 14. This occurs during the processing stages to process the film in a manner which will be described later.

In a further feature of the invention, drive shaft 261 can be moved perpendicularly and through flange 251 and flange 252 to move disk 30 attached thereto. As shown in FIG. 9A, drive shaft 261 is attached to a fitting 264 in a manner which permits drive shaft 261 to rotate relative to fitting 264. Fitting 264 is in turn rotatably attached to a pivotable arm 262 and a movable member 263. Movable member 263 can be operationally connected to a motor for rotation of member 263. This causes arm 262 to pivot about point 262' to move drive shaft 261 to the left or right when viewing FIG. 9A from above the page. Movement of drive shaft 261 as noted above, moves disk 30 in a direction parallel to an axis of disk 30. This facilitates the accommodation of, for example, 35 mm and APS film on disk 30, since the disk 30 can be moved based on the type of film being processed.

Figure 10:
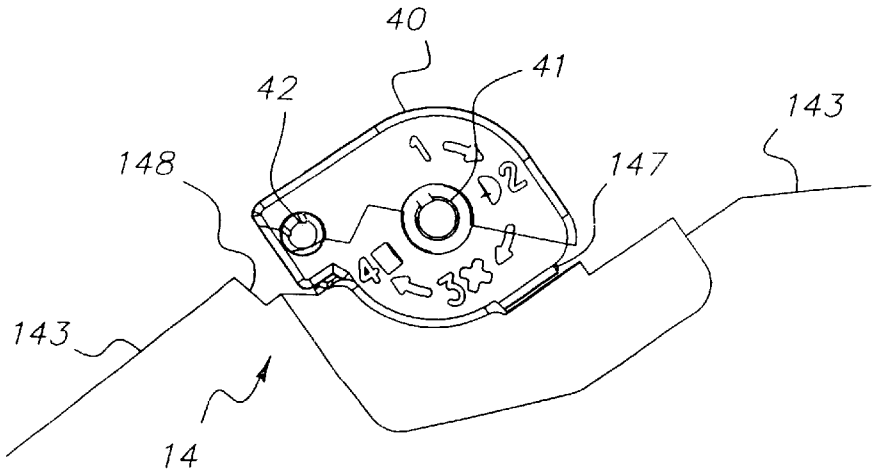
FIG. 10 depicts a film cartridge in a film-loading position using one film-loading method of present invention.

Within the context of the present invention, a film may be loaded into circular processing drum 14 by a number of methods. One method of loading film, such as APS film, into circular processing drum 14 is shown in FIGS. 10–13. As shown in FIG. 10, film cartridge 40 comprising a film cartridge spool 41 and film cartridge door opening mechanism 52 is positioned in a film cartridge loading area 147 located on side wall 143 of circular processing drum 14. Film (not shown) exiting film cartridge 40 enters circular processing drum 14 at light tight film input slot 148 (FIG. 3) in side wall 143 of circular processing drum 14.

Figure 11:
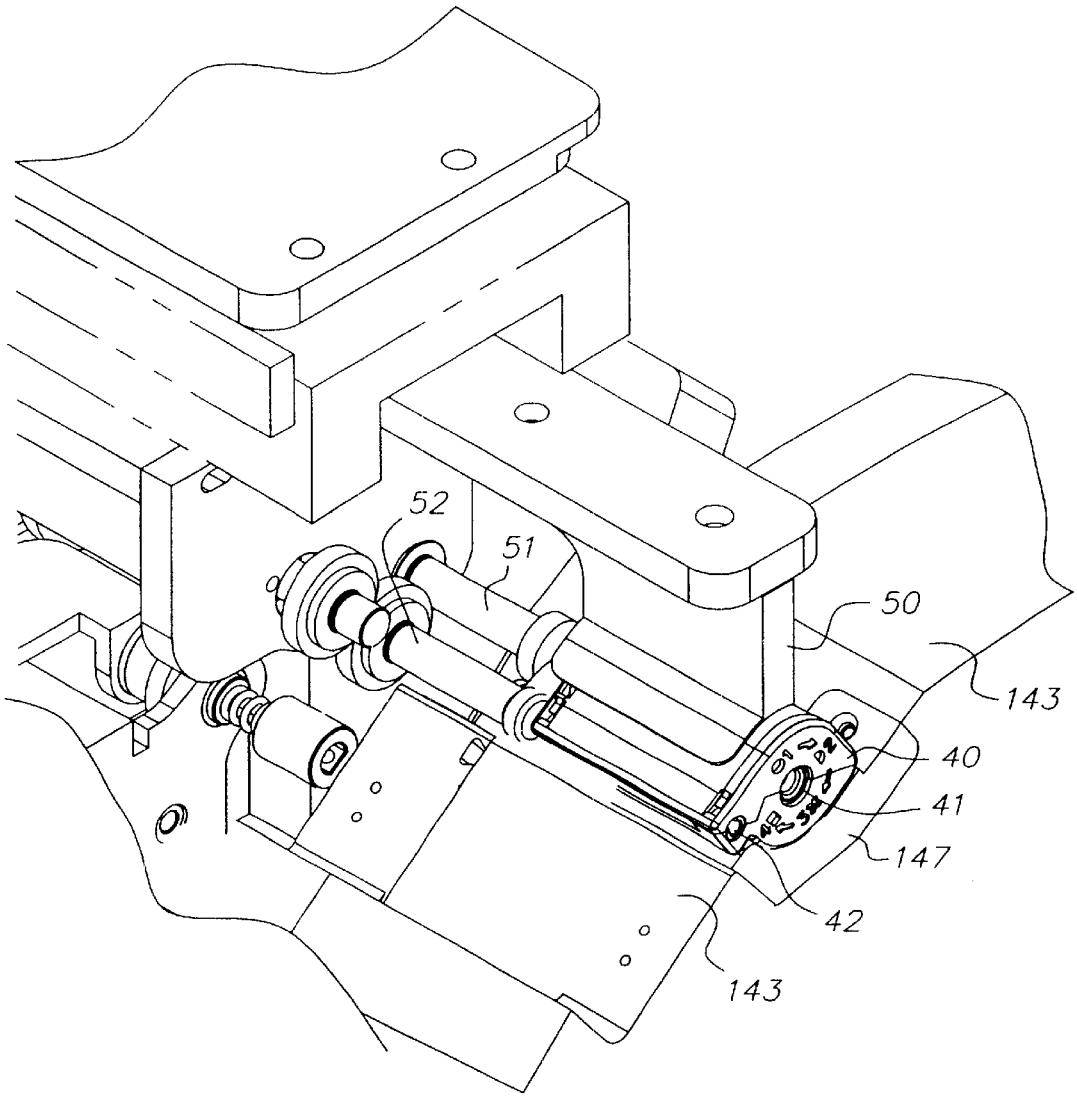
FIG. 11 depicts a film cartridge stabilizing step in one film-loading method of the present invention.

Once film cartridge 40 is positioned in film cartridge loading area 147, the photographic processor 10 of the present invention initiates a number of film-loading and conveying steps, the results of which are shown in FIG. 11. It is noted that the film loading and conveying steps as well as other processing steps can be controlled by a computer or central processing unit 2000 (FIG. 1) operationally associated with processor 10. In a first step, a film cartridge stabilizing member 50 applies an amount of pressure onto an upper surface of film cartridge 40 to prevent film cartridge 40 from moving while positioned in film cartridge loading area 147. Spool engaging member 51 and cartridge door opening mechanism engaging member 52 move toward film cartridge 40 and engage with film cartridge spool 41 and film cartridge door 42, respectively. Door opening mechanism engaging member 52 opens film cartridge mechanism 42 and spool engaging member 51 begins to rotate film cartridge spool 41, forcing film (not shown) out of film cartridge 40.

Figure 12:
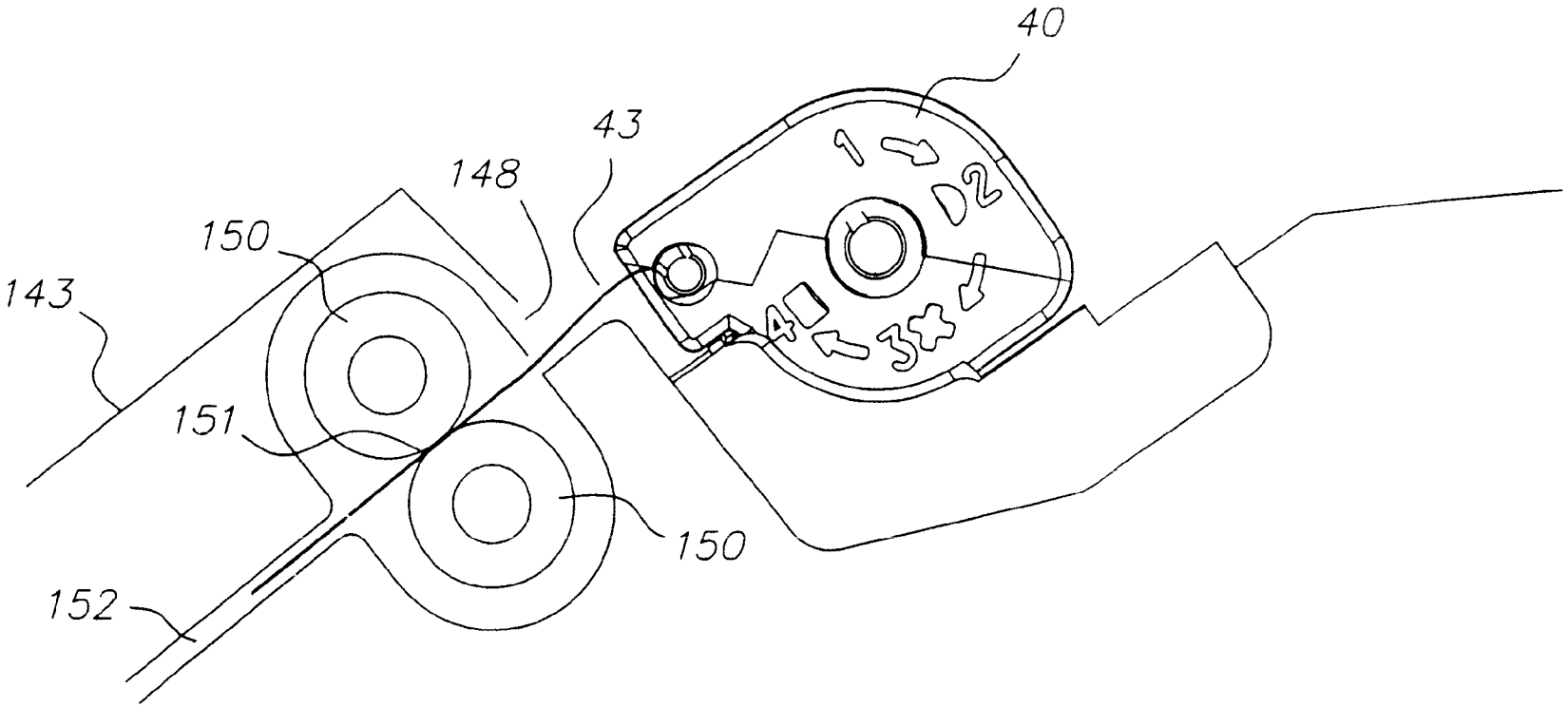
FIG. 12 depicts a film nipping step during a film-loading method of the present invention.
Figure 13:
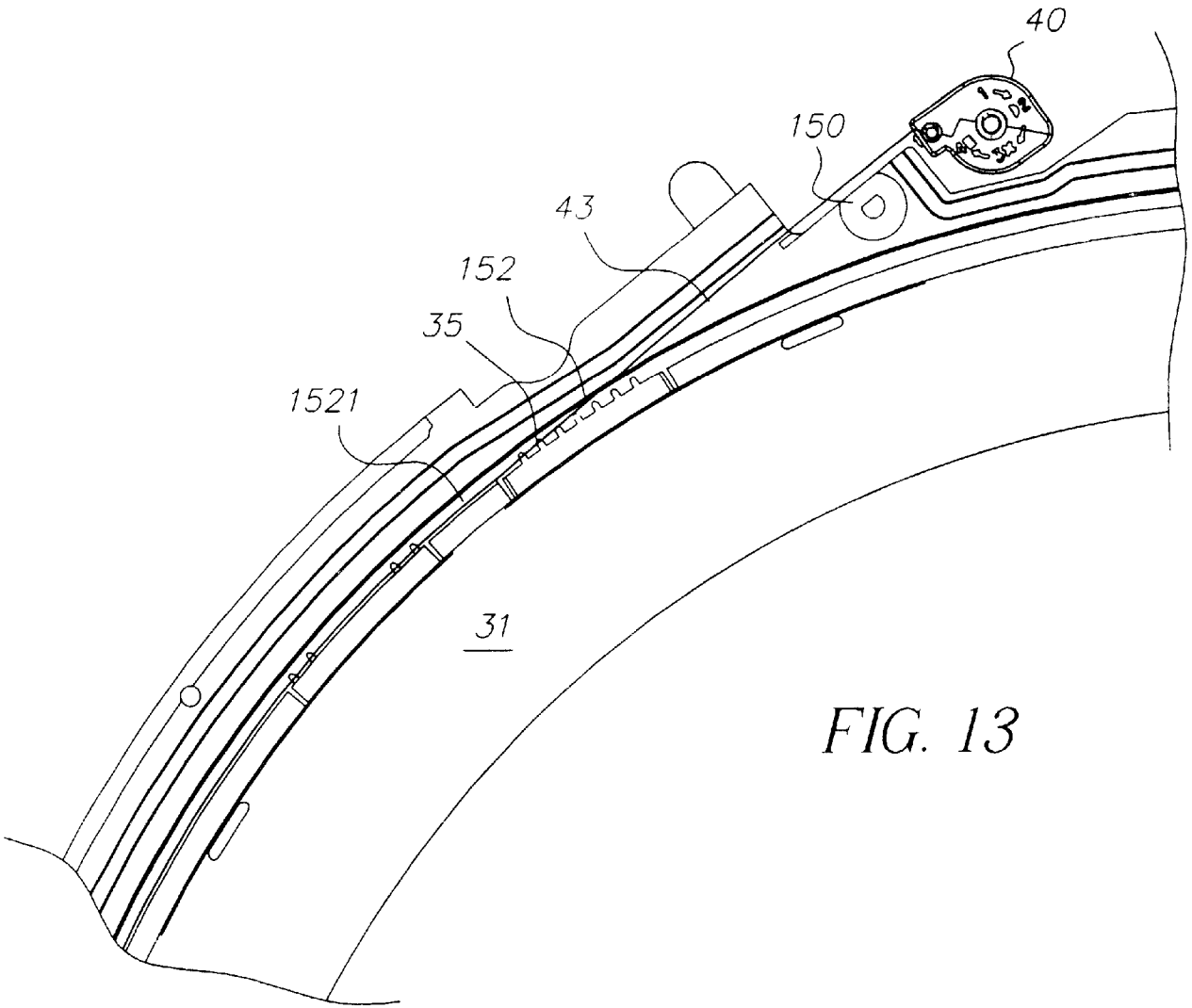
FIG. 13 depicts a cross-sectional view of film entering into a circular processing one film-loading method of the present invention.

FIG. 12 shows a strip of film 43 exiting film cartridge 40 and entering film input slot 148 of circular processing drum 14. Driven nip rollers 150 grasp a leading edge of the strip of film 43 at drum roller nip point 151 and advance film 43 further into circular processing drum 14. As shown in FIG. 13, the strip of film 43 exits drum cavity slot 152 and enters into the drum processing cavity 1521 of circular processing drum 14, wherein one or more sets of disk teeth 35 on disk 30 interengage with holes or perforations along an edge of the strip of film 43. As previously described, disk teeth 35 could be spring loaded so as to spring up at the appropriate time and interengage with the holes or perforations along film 43. With clutch 250 disengaged, disk 30 and rollers 150 are rotated while circular processing drum 14 remains stationary. This causes film 43 to advance into the processing cavity 1521 of circular processing drum 14 a desired distance equal to the length of the strip or roll of film 43. As shown in FIGS. 10–13, in this film-loading method of the present invention, the film 43 remains intact with film cartridge 40.

A number of commercially available films may be loaded according to the film-loading method described above, namely, wherein the film remains intact with its corresponding film cartridge during processing. A suitable film, which may be used in this particular film-loading method, includes, but is not limited to, APS film. Desirably, APS film is loaded into the photographic processor of the present invention according to this method.

Figure 14:
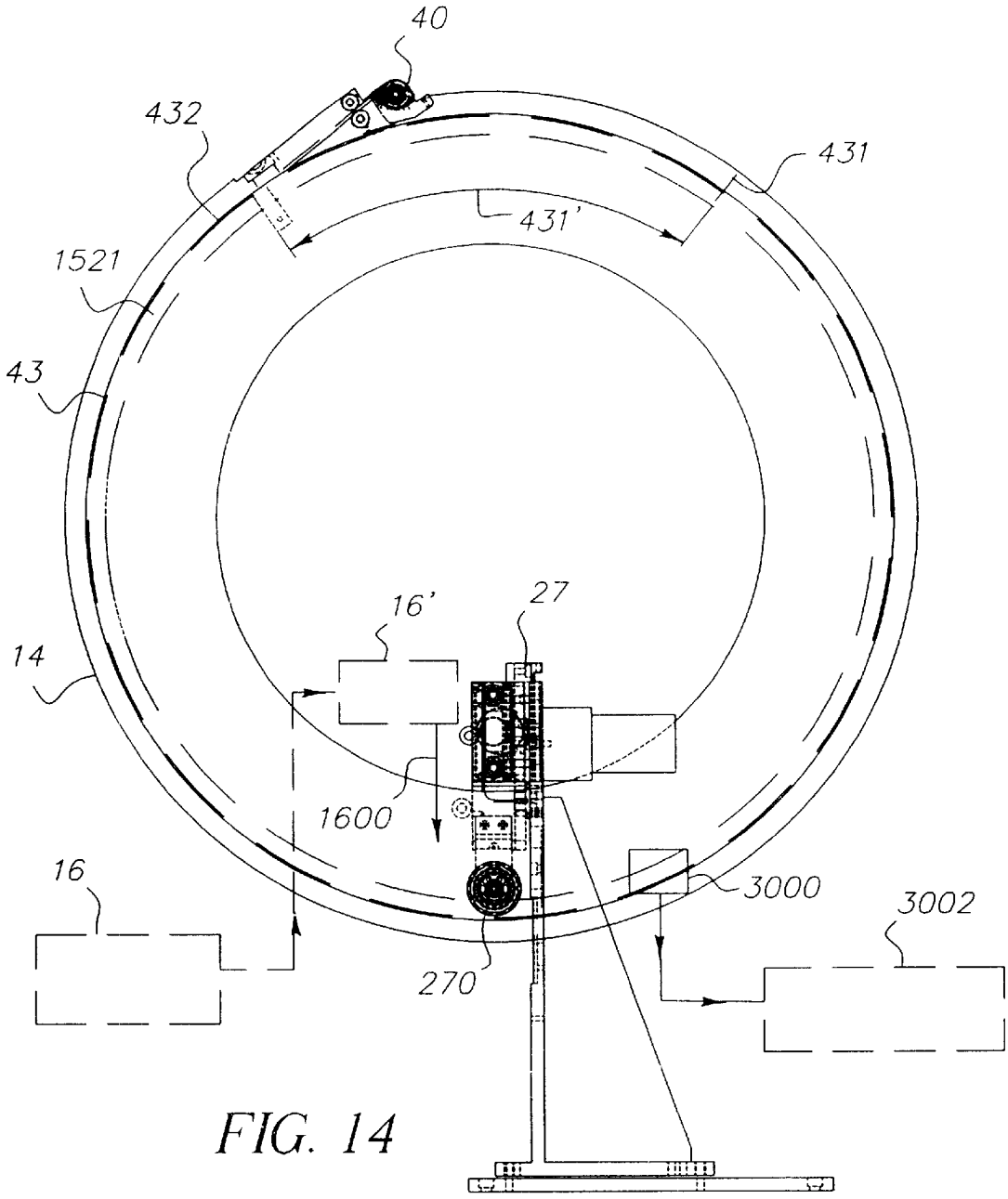
FIG. 14 depicts a sheet of film having a lead end and a tail end within the drum processing cavity of a circular processing drum.

FIG. 14 depicts circular processing drum 14 fully loaded with film 43 having a forward end 431 and a rearward end 432 within the drum processing cavity 1521 of circular processing drum 14. The back end of film 43 is maintained in cartridge 40. Film 43 is now positioned within circular processing drum 14 for chemical processing, wherein one or more processing fluids are deposited into circular processing drum 14 and placed in contact with film 43 for a desired period of time.

It is noted that the circumference of the drum will be longer than the length of the film to be processed. Therefore, when the film is loaded in drum 14, a section of drum 14 will not have film therein. This is referred to as a film-free zone 431' (FIG. 14). Prior to delivering chemistry by way of chemical supply 16 and a chemical delivery mechanism 16' (FIG. 14), clutch 250 is activated or engaged and drum 14 is controllably rotated with disk 30 so that film-free zone 431' is at a lower end or below chemical delivery mechanism 16'. Chemical delivery mechanism 16' is preferably of the type which drops or delivers chemistry into drum 14 in the direction of arrow 1600 (FIG. 14). The movement of film-free zone to an area below chemical delivery mechanism 16' prior to the delivery of chemicals prevents the chemicals from being dropped directly on the film which could cause uneven processing. Thereafter, processing occurs by continuously rotating the drum 14 and disk 30. Further, as shown in FIG. 14, in the lower portion of drum 14, film 43 passes between wheel 270 and an inner surface of drum 14. Rotation of drum 14 and disk 30 relative to wheel 270 helps to agitate the processing fluid in the vicinity of wheel 270 to promote processing. Following the chemical processing steps, the film 43 is removed from circular processing drum 14 and exposed to a drying operation. One method of removing film 43 from circular processing drum 14 is shown in FIGS. 15A and 15B.

Figure 15A:
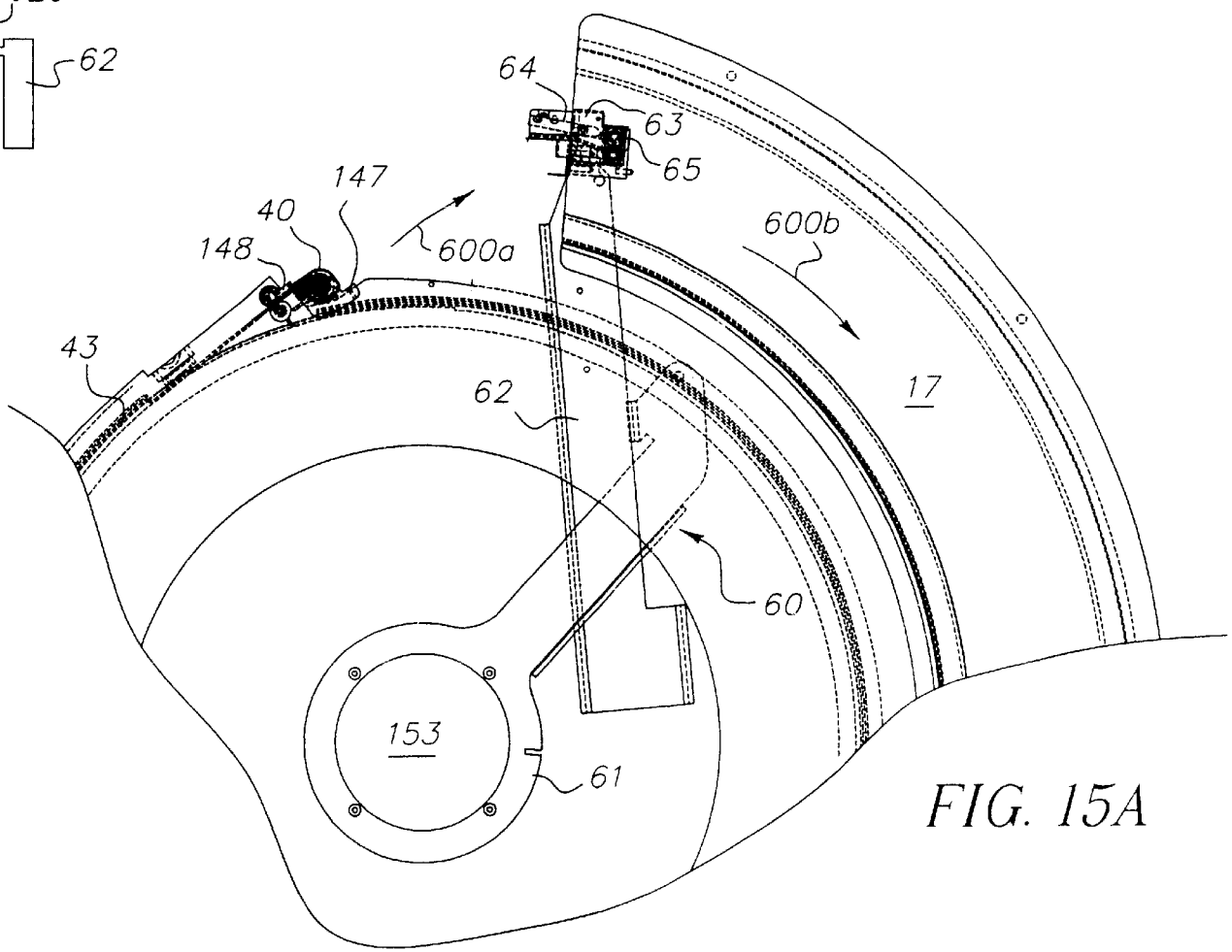
FIGS. 15A and 15B depicts an exemplary film transfer arm, which transfers film from a circular processing drum to a dryer.
Figure 15B:
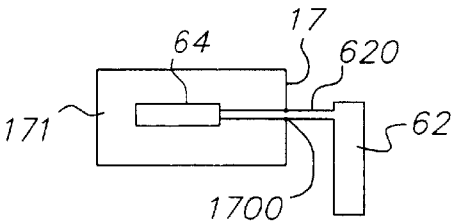

As shown in FIG. 15A, film transfer arm assembly 60 is positioned to move or pivot between circular processing drum 14 and dryer 17. Film transfer arm assembly 60 includes a lower arm member 61, which is rotatable around an axis of symmetry 153 of circular processing drum 14. Film transfer arm assembly 60 also includes an upper arm member 62, which is pivotally attached to lower arm member 61. At upper arm member end 63, film transfer arm assembly 60 includes a film cartridge gripper 64 and film strip gripper rolls 65. As shown in FIG. 15B, which is a front view of the entrance of dryer 17, a side wall of dryer 17 includes a slot 1700 with a rubber seal that extends along the length of the dryer. Upper arm member 62 includes a shaft 620 which extends from upper arm member 62, through slot 1700 and is connected to gripper 64. This permits transfer arm assembly 60 to pull gripper 64 and thus the film to be dried though the dryer.

In embodiments wherein the film 43 remains intact with film cartridge 40 (as described above), film cartridge gripper 64 of film transfer arm assembly 60 engages with film cartridge 40, pulls film cartridge 40 from loading area 147 and the strip of film 43 from circular processing drum 14 in direction 600*a*, and proceeds through dryer 17 in direction 600*b*. Therefore, cartridge 40 with processed film 43 attached and trailing therefrom is conveyed through dryer 17 to dry film 43 by, for example, the blowing of air into dryer 17. In other embodiments where the film 43 is detached from film cartridge 40 (described below), film sheet gripper rolls 65 grip an edge of film 43 as film 43 exits film input slot 148 of circular processing drum 14. Film sheet gripper rolls 65 of film transfer arm assembly 60 pull film 43 from circular processing drum 14 and proceeds through dryer 17. Once dried, film 43 is re-wound back into its cartridge 40 prior to proceeding to scanner 18'.

Figure 16:
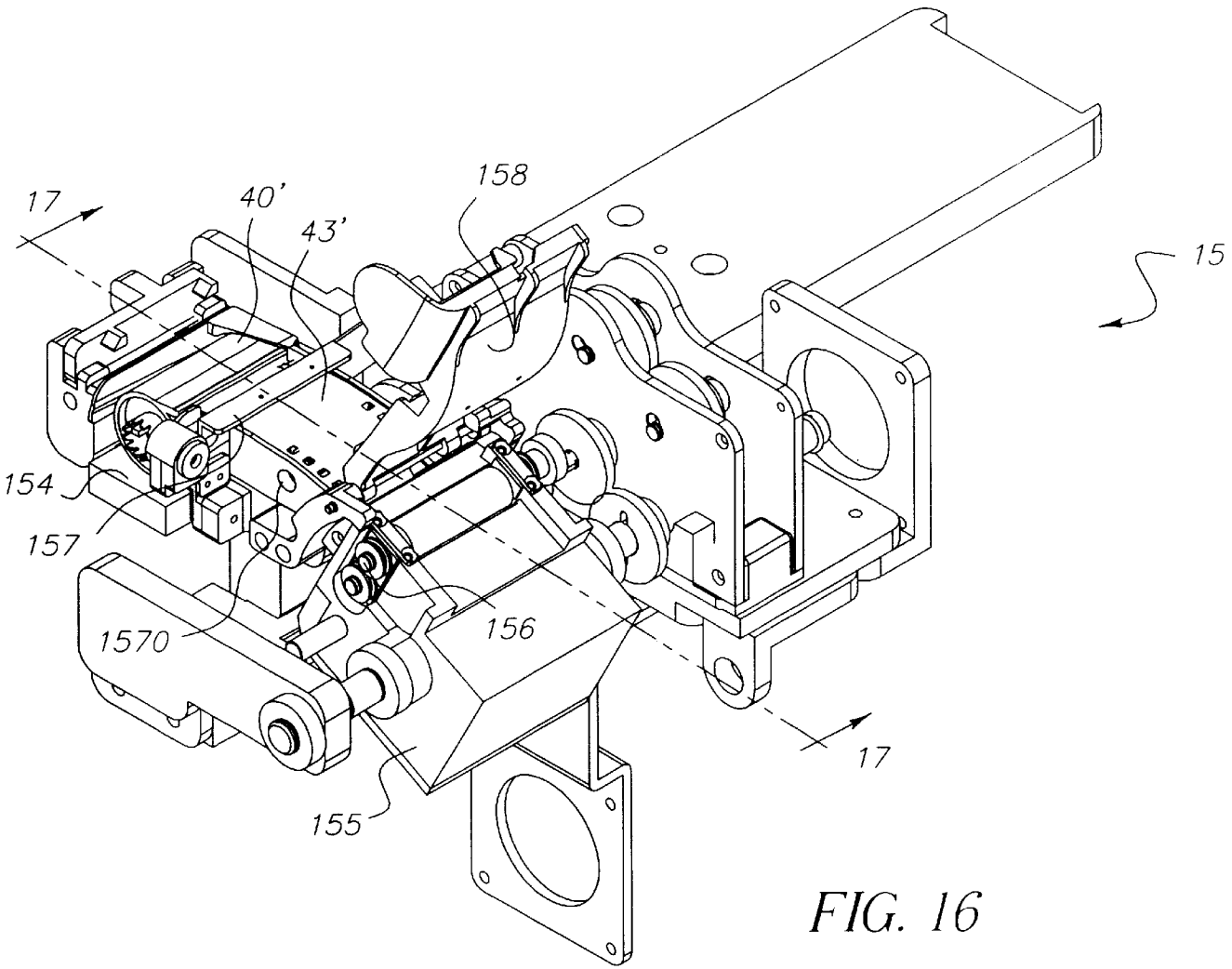
FIG. 16 depicts an exemplary film loading/unloading device used in a film-loading method of the present invention wherein film is separated from its corresponding film cartridge.

In a further film-loading method of the present invention, the film is separated from its film cartridge prior to processing within circular processing drum 14 (for example, 35 mm film). In this method, a film loading/unloading device, such as exemplary film loading/unloading device 15 as shown in FIG. 16, may be used. Film loading/unloading device 15 includes a film cartridge loading area 154, which can be enclosed by closing a door 158. In film loading area 154, an operator extracts the tongue of film 43' from cartridge 40' and engages the perforations on film 43' with sprockets on a driven roller 1570. Thereafter door 158 is closed and film 43' proceeds into festoon box 155 through festoon box nip rollers 156. Once a desired length of film is removed from film cartridge 40', a cutter 157 slices film 43' to separate film 43' from film cartridge 40'. Any counter device (not shown) may be used to measure the length of the strip of film 43' passing through festoon box nip rollers 156. The length measurement is used in further processing steps as described below.

Figure 17:
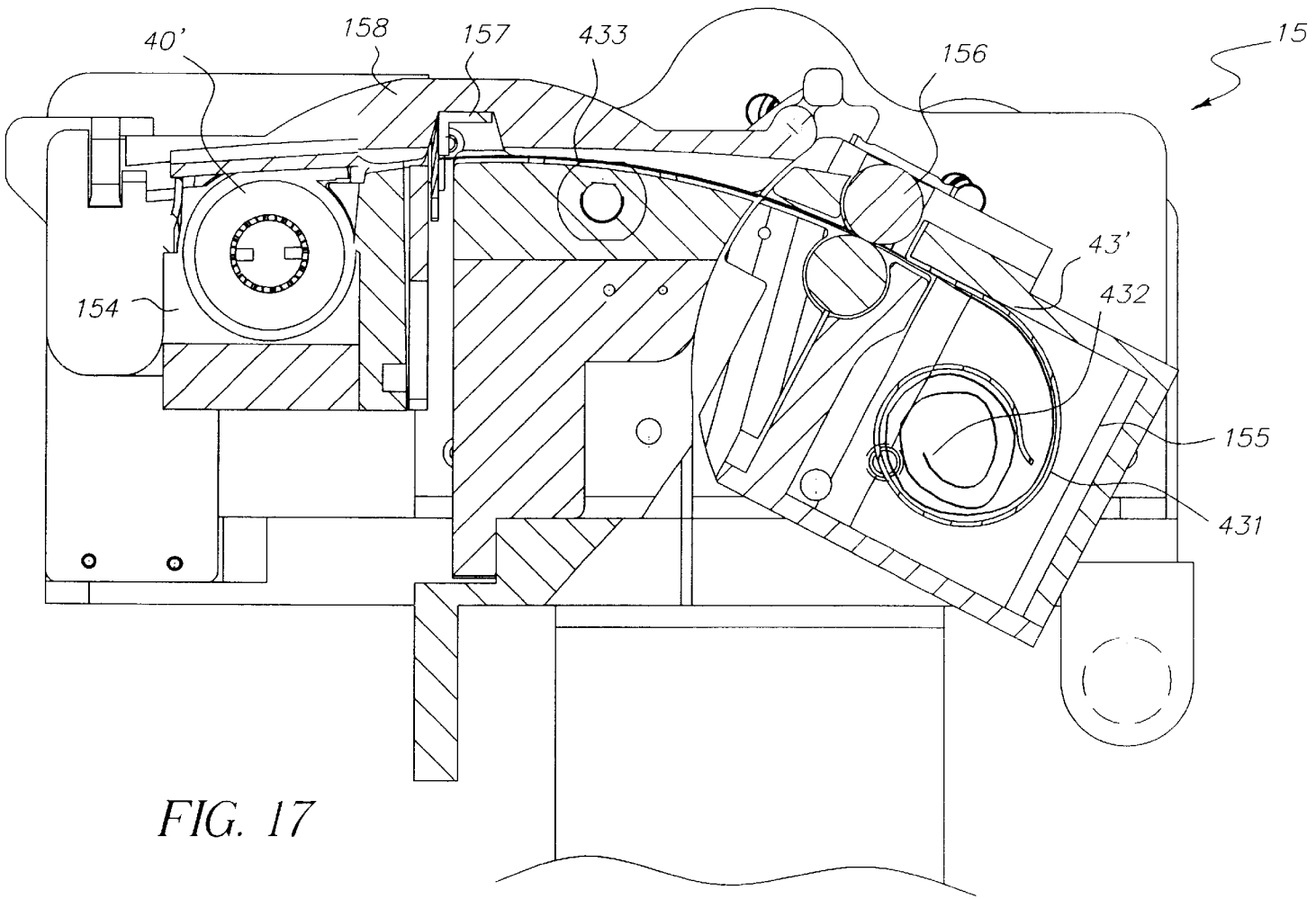
FIG. 17 depicts a cross-sectional view of the exemplary film loading/unloading device as seen along line 17—17 in FIG. 16.

FIG. 17 depicts a cross-sectional view of film loading/unloading device 15 as seen along line 17—17 in FIG. 16. As shown in FIG. 17, film cartridge 40' is positioned in film cartridge loading area 154 while a strip of film 43' is removed from film cartridge 40' and transported to festoon box 155 where it is turned. In this film-loading operation, a reverse roll of film 431 is formed from the film 43' in festoon box 155. A lead end of film 432 becomes the innermost portion of the reverse roll 431 while a tail end of film 433 becomes the outermost portion of reversed roll 431. When the film 43' is subsequently fed into circular processing drum 14 (as previously described), tail end 433, which contains the last exposures on the strip of film 43', is fed into circular processing drum 14 first.

Figure 18:
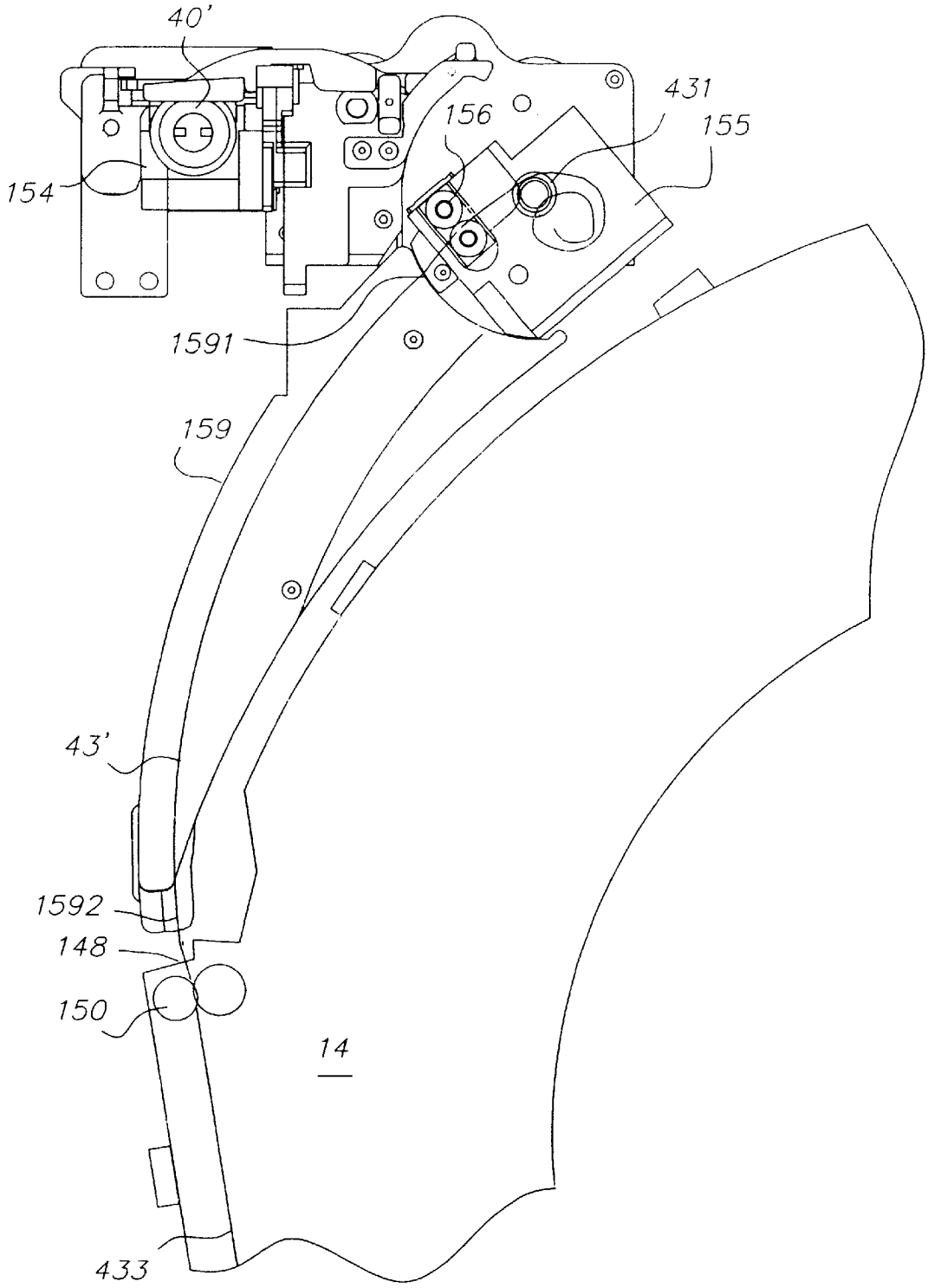
FIG. 18 depicts an exemplary film-loading guide used to load a film roll into a circular processing drum.

A film-loading guide 159 is used to load reverse roll 431 into circular processing drum 14 as shown in FIG. 18. Festoon box 155 rotates from an initial position (as shown in FIGS. 16 and 17) to a film-loading position as shown in FIG. 18. Festoon box nip rollers 156 turn to advance tail end 433 of reverse roll 431 into film-loading guide 159 at guide entrance slot 1591. The film 43' exits the film-loading guide 159 at guide exit slot 1592 positioned adjacent to film input slot 148 of circular processing drum 14. Once the tail end 433 of the strip of film 43' enters into circular processing drum 14, driven nip rollers 150 grab the film 43' and advance the film 43' into circular processing drum 14 as described above. It should be noted that in this film-loading method, nip rollers 150 are programmed to advance the film 43' into circular processing drum 14 a specific length, which corresponds to the length of film inputted into festoon box 155 and measured via festoon box nip rollers 156 as described above. In other words, nip rollers 150 advance the strip of film 43' into circular processing drum 14 so that lead end 432 of film 43' remains nipped between nip rollers 150 during chemical processing (i.e., lead end 432 of the strip of film 43' does not enter into drum processing cavity 1521). This permits all of the exposed areas of the film 43' to be in the processing area in the drum.

Figure 19:
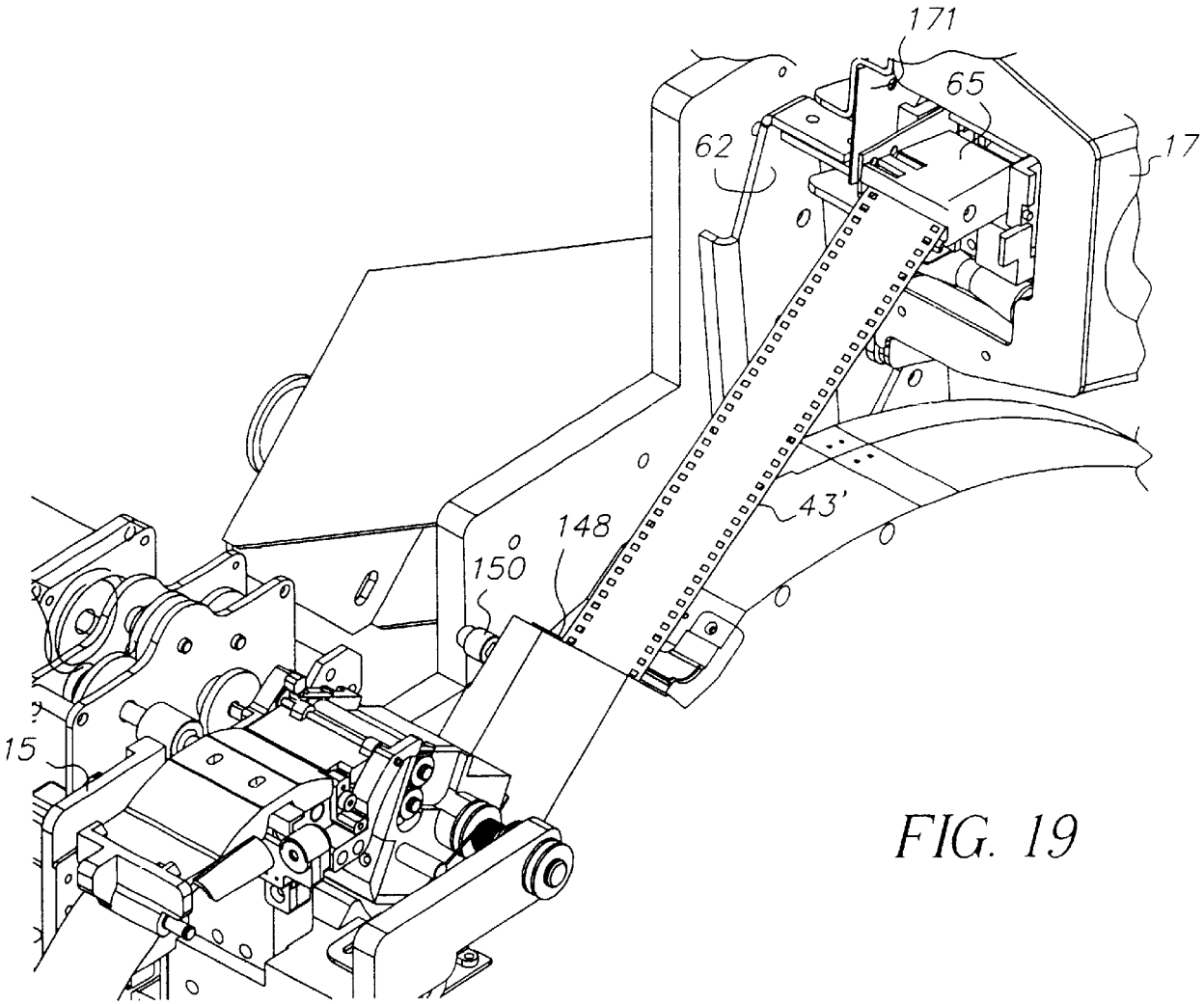
FIG. 19 depicts a film transfer step, wherein a strip of film is transferred from a circular processing drum to a dryer by film sheet gripper rolls attached to a film transfer arm.
Figure 20:
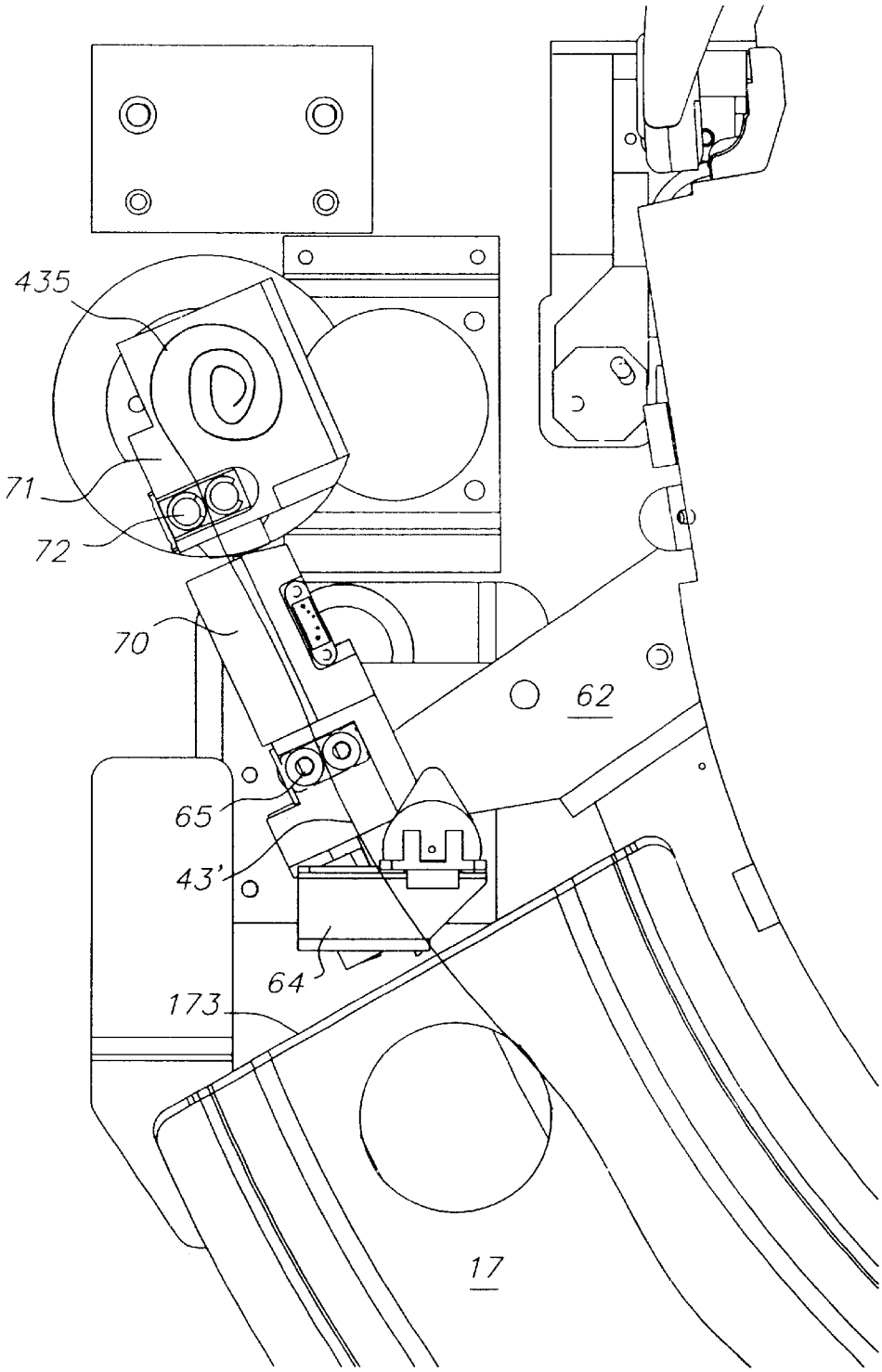
FIG. 20 depicts a film processing step, wherein a strip of film exits a dryer into a scanner festoon box.

Following the chemical processing steps, film 43' is transferred to dryer 17 by film transfer arm assembly 60 as described above. As shown in FIG. 19, the strip of film 43' is pulled from circular processing drum 14 through film input slot 148 by film sheet gripper rolls 65 attached to upper transfer arm member 62. Nip rollers 150 provide a first end (corresponding to lead end 432) to film sheet gripper rolls 65. In FIG. 19, film sheet gripper rolls 65 are shown positioned at dryer entrance 171. From this position, film sheet gripper rolls 65 proceed through dryer 17 pulling the film 43' through dryer 17. As shown in FIG. 20, upper film transfer arm member 62 exits dryer 17 at dryer exit 173 and comes into contact with a conduit 70. Film sheet gripper rolls 65 turn to advance the film 43' through conduit 70 and into scanner festoon box 71. Scanner festoon box nip rollers 72 grasp a leading edge of film 43' and force film 43' into scanner festoon box 71 forming scanner film roll 435. Scanner festoon box nip rollers 72 advance film 43' into scanner festoon box 71 a specific distance equal to the predetermined length of film 43' so that the tail end of film 43' remains nipped between scanner festoon box nip rollers 72 to go to the scanner.

Figure 21:
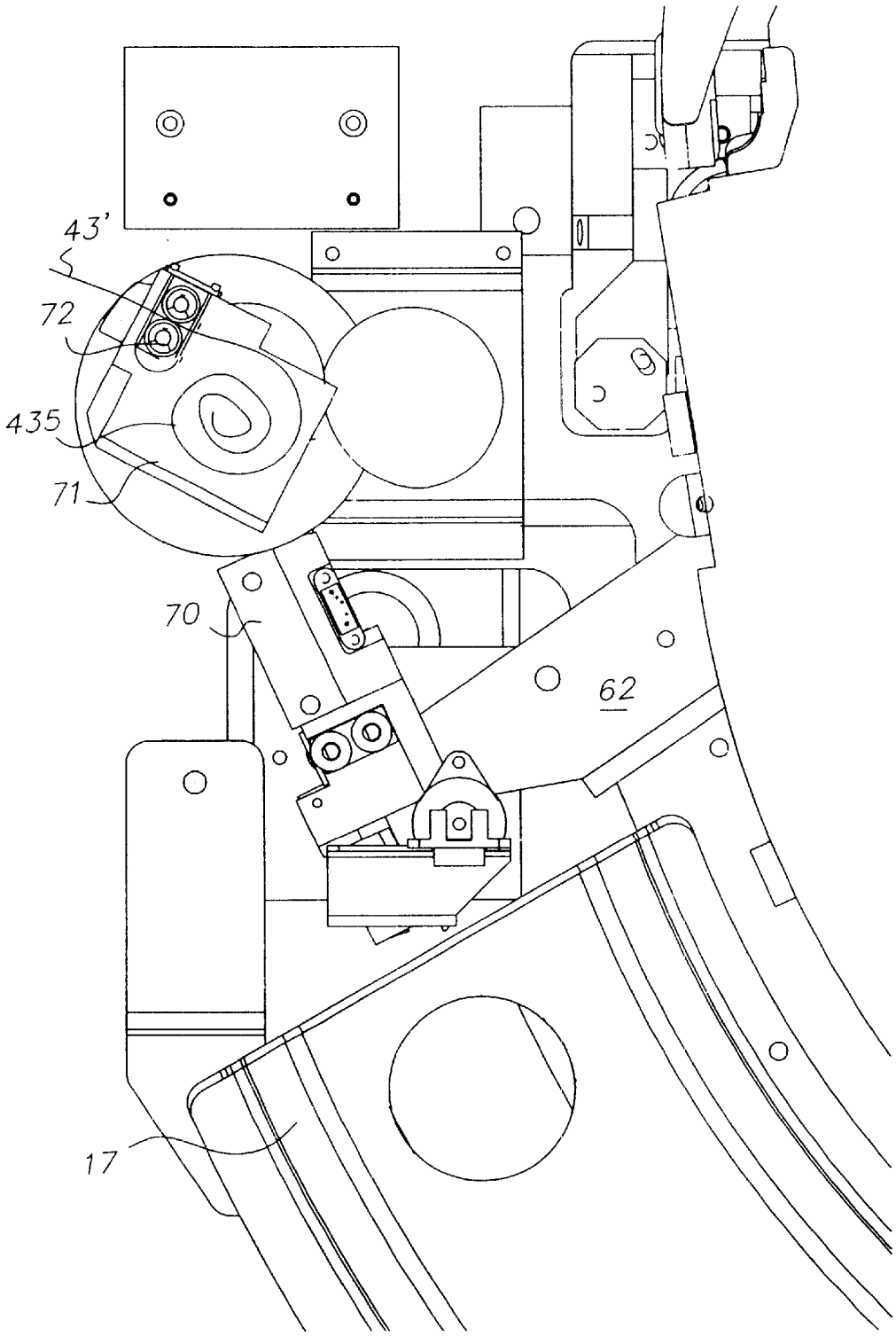
FIG. 21 depicts a film processing step, wherein a strip of film exits a festoon box and a scanner.

In one embodiment of the present invention, film 43' may be further processed by transporting the film 43' to scanner 18'. As shown in FIG. 21, scanner festoon box 71 rotates from an initial position (as shown in FIG. 20) to a secondary position so that the film 43' may be fed to scanner 18'. Scanner 18' may supply image data to computer 2000 or a remote computer (not shown) for further image processing. Following scanning, the film 43' may be packaged as a film roll or as strips of film and returned to the customer along with scanned photographs in electronic format on an electronic disc if desired.

A number of commercially available films may be loaded according to the film-loading method described above, namely, wherein the film is separated from its corresponding film cartridge during processing. Suitable films, which may be used in this particular film-loading method, include, but are not limited to, 135 mm film. Desirably, 135 mm film is loaded into the photographic processor of the present invention according to this method.

The photographic processor of the present invention may be used to process one or more types of film. Suitable films include, but are not limited to, APS film, 135 mm film, etc. Desirably, the photographic processor of the present invention is designed to process APS film, 135 mm film, or both APS and 135 mm film. The photographic processor of the present invention may be categorized as a "single-roll" processing unit given that the circular processing drum only processes one roll of film at a time. However, it should be noted that the photographic processor of the present invention is capable of processing multiple rolls of film at a given time. For example, one roll of film may be in the circular processing drum, while a second roll of film is in the dryer and a third roll of film is in the scanner.

The photographic processor of the present invention may include other components other than those described in FIGS. 1–21. For example, the photographic processor of the present invention may include an operator interface control panel operationally associated with computer 2000 (FIG. 1); a display screen; a control unit, wherein the control unit accepts input from a processor user, provides machine settings to one or more components of the processor based on the input of the user, and controls and executes a processing operation of the processor; and multiple film loading doors on an outer surface of the photographic processor housing. In one desired embodiment of the present invention, the photographic processor is used to process APS film and 135 mm film. In this embodiment, the photographic processor has two separate film loading doors on an outer surface of the photographic processor housing, one for an APS film cartridge and the other for a 135 mm film cartridge.

The photographic processor of the present invention may come in a variety of sizes depending on a number of factors including, but not limited to, the desired size of the circular processing drum, the desired storage capacity of the chemical delivery system, and the desired storage capacity of the waste collection reservoir. One of the benefits of the photographic processor of the present invention is the ability to place the photographic processor in a given room without occupying a large amount of space.

Another benefit of the photographic processor of the present invention is that the only requirement necessary to operate the photographic processor in a given room is a source of electricity. Since the photographic processor of the present invention can operate with working strength chemistry, the processor does not require a water source or drain for processing chemicals. A minimum amount of processing chemicals is needed to operate the photographic processor of the present invention due to the unique design of the circular processing drum. Further, a minimum amount of chemical waste is generated due to the design of the circular processing drum.

The circular processing drum of the photographic processor may vary in size depending on a number of factors including, but not limited to, the type of film processed, the length of the film processed, the width of the film processed, and the desired overall dimensions of the photographic processor. In one embodiment of the present invention, the length of the drum (i.e., the dimension perpendicular to the diameter of the drum) is substantially equal to the sum of (1) a thickness of the front wall of the drum, (2) a thickness of the back wall of the drum, and (3) a width of the strip of processible film. In a further embodiment of the present invention, the drum has a circumference, which is slightly greater than largest length of the roll film.

In one embodiment of the present invention, the photographic processor comprises (1) a circular processing drum having a front wall, a back wall, a side wall connecting the front wall to the back wall and extending around a perimeter of the drum, and a horizontally extending axis of symmetry, wherein the diameter of the drum is greater than a length of the drum, which is measured along the axis of symmetry; (2) a disk positioned inside the drum in a plane parallel to both the front wall and the back wall, wherein the disk comprises one or more sets of disk teeth along an outer perimeter of the disk capable of interengaging with holes along a first edge of a sheet of processible film; and (3) a mechanism for rotating the disk while the drum is stationary. The mechanism for rotating the disk may be capable of rotating the disk and the drum simultaneously, or selectively rotating only the disk. The mechanism for rotating the disk may comprise a number of components including, but not limited to, a motor, a clutch, and a drive axis, wherein the drive axis is positioned along the axis of symmetry of the drum.

The circular processing drum and/or the disk may be rotated at a speed depending on a number of factors including, but not limited to, the type of film, the size of the circular processing drum, the desired amount of contact time between each of the one or more processing solutions and the roll of film, and the desired speed at which film is introduced into the circular processing drum.

In a further embodiment of the present invention, the photographic processor comprises a circular processing drum, wherein the circular processing drum comprises a disk having one or more sets of teeth. The one or more sets of teeth interengage with holes along the film to pull the film into the circular processing drum.

The photographic processor of the present invention may use any conventional chemical delivery system known in the art as long as the chemical delivery system is capable of inputting one or more processing fluids into the circular processing drum. Suitable chemical delivery systems deliver one or more processing fluids including, but not limited to, a developing solution, a bleach solution, a fix solution, a wash solution, or a combination thereof. Desirably, the chemical delivery system comprises one or more separate containers for each of the processing fluids. For example, the chemical delivery system may comprise one or more separate containers containing a developing solution, one or more separate containers containing a bleach solution, one or more separate containers containing a fix solution, and one or more separate containers containing awash solution. In one embodiment of the present invention, the chemical delivery system used in the photographic processor comprises one container of developing solution, one container of bleach solution, one container of fix solution, and at least one container of wash solution.

Desirably, the photographic processor of the present invention utilizes a chemical delivery system comprising "working strength" chemical solutions. As used herein, the term "working strength" is used to describe chemical solutions, which are prepackaged in separate containers at concentrations that do not require dilution with other solutions (i.e., a source of water), and can be used as is.

Further, the photographic processor of the present invention may use any conventional chemical removal system to remove one or more processing fluids from the circular processing drum. Suitable chemical removal systems include, but are not limited to, a suction device or a drain 3000 (FIG. 14) in the side wall of the circular processing drum. Typically, the chemical removal system further comprises a chemical waste reservoir 3002 (FIG. 14) for storing one or more processing fluids removed from the drum. Desirably, the chemical waste reservoir is designed to contain all of the waste resulting from the use of all of the processing fluids contained in the chemical delivery system.

As discussed above, the photographic processor of the present invention uses a minimum amount of photoprocessing chemicals, and consequently generates a minimum amount of chemical waste.

The dryer of the invention should be capable of drying the processed film. The dryer may use air and/or radiant heat to dry the processed film. Desirably, the dryer has a capacity, which minimizes the amount of dwell time within the dryer. Also, it is preferable that the dryer be compact and positioned next to the circular processing drum as shown in FIGS. 1–2 above.

The photographic processor of the present invention may include a film-loading device, wherein the film loading device comprises one or more of the following components: (a) a film cartridge stabilizing bar for fixing a position of a film cartridge in a film cartridge loading area on an outer surface of the side wall; (b) a film cartridge door opening device; (c) a film cartridge spool turning device; (d) a festoon box for storing film removed from a film cartridge; (e) a cutting device for cutting film to separate the film from a film cartridge; and (i) a festoon box nip rollers for gripping film. Desirably, the film-loading device comprises all of the above components.

In a further desired embodiment of the present invention, the photographic processor comprises (1) a circular processing drum having a front wall, a back wall, a side wall connecting the front wall to the back wall and extending around a perimeter of the drum, and a horizontally extending axis of symmetry, wherein the diameter of the drum is greater than a length of the drum, which is measured along the axis of symmetry of the drum; (2) a disk positioned inside the drum in a plane parallel to both the front wall and the back wall, wherein the disk comprises one or more sets of disk teeth along an outer perimeter of the disk capable of interengaging with holes along a an edge of a strip of processible film; and (3) a disk positioning device, wherein the disk positioning device moves the disk within the drum to change a distance between the disk and the front wall of the drum. The photographic processor may further comprise a mechanism (a) for rotating the disk and the drum simultaneously, and (b) for rotating the disk while the drum is stationary.

The present invention is further directed to a photographic process, wherein the process comprises the steps of: (1) loading a sheet of processible film into a circular processing drum, wherein the circular processing drum comprises (a) a front wall, (b) a back wall, (c) a side wall connecting the front wall to the back wall and extending around a perimeter of the drum, and (d) a horizontally extending axis of symmetry, wherein the drum has a diameter greater than a length of the drum, the length of the drum being measured along the axis of symmetry of the drum, and wherein the drum contains a disk positioned inside the drum in a plane parallel to both the front wall and the back wall, wherein the disk comprises one or more sets of disk teeth along an outer perimeter of the disk capable of interengaging with holes along a first edge of the sheet of processible film; (2) contacting the sheet of processible film with one or more processing fluids in the circular processing drum; (3) rotating the circular processing drum along the axis of symmetry for a period of time; (4) removing the one or more processing fluids from the circular processing drum; and (5) drying the film. In the above method, the loading step may comprise one or more of the following steps: (i) feeding the sheet of processible film into the circular processing drum through a film-loading slot in the side wall of the drum; (ii) nipping the sheet of processible film to move the sheet of processible film into contact with the one or more sets of disk teeth along the disk; and (iii) rotating the disk while the drum remains stationary to advance the sheet of processible film into the circular processing drum.

The photographic process of the present invention may comprise contacting a strip of film with one or more processing fluids selected from a developing solution, a bleach solution, a fix solution, a wash solution, or a combination thereof In one embodiment, the photographic process comprises a contacting step, which comprises (i) inputting a developing solution into the circular processing drum; (ii) inputting a bleach solution into the circular processing drum; (iii) inputting a fix solution into the circular processing drum; and (iv) inputting at least one wash solution into the circular processing drum. The contacting step of the process may further comprise separate removal steps following a washing solution input step. As an alternative, the process may comprise inputting a developing solution into the drum; inputting a fix solution into the drum; inputting a bleach solution into the drum; and inputting at least one wash solution into the drum.

The photographic process of the present invention may further comprise a rotating step, wherein the rotating step comprises rotating the drum and the disk simultaneously. The drum and the disk may be simultaneously rotated after each processing solution input step for a period of time in order to insure a desired amount of contact between each processing solution and the film.

The photographic process of the present invention may comprise a series of processing steps, wherein the film remains intact with its corresponding film cartridge (for example, APS film). In other embodiments, the photographic process of the present invention comprises removing the processible film from a film cartridge (i.e. 35 mm film), and cutting the processible film to separate the processible film from the film cartridge. When the film is to remain intact with its film cartridge (i.e. APS film), the photographic process of the present invention may comprise one or more of the following film loading steps: (a) positioning a film cartridge containing the strip of processible film in a film cartridge loading area on an outer surface of the side wall; (b) applying a film cartridge stabilizing bar to an upper surface of the film cartridge to secure the film cartridge; (c) opening a door of the film cartridge; and (d) turning a spool within the film cartridge. When the film is to be separated from its film cartridge (i.e. 35 mm film), the photographic process of the present invention may comprise one or more of the following film loading steps: (a) positioning a film cartridge containing the strip of processible film in a film cartridge loading area adjacent to a festoon box; (b) pulling a tongue on the film from the film cartridge using, for example, a film extraction tool; (c) engaging perforations on the film on a sprocket wheel; (d) transferring the film from the film cartridge to the festoon box to form a roll of film; wherein a last exposure on the film is on an outer portion of the roll of film; and (e) cutting the film to separate the film from the film cartridge.

In a further embodiment, the present invention is directed to a photographic process which comprises moving a disk within a circular processing drum along an axis of symmetry of the drum to change a distance between the disk and a wall, such as the front wall, of the drum. In this embodiment, the photographic process is capable of processing different types of film using the same circular processing drum by adjusting the position of the disk within the circular processing drum.

The described embodiment includes a disk 30 which is movable in a direction parallel to a rotational axis of the disk (see for example FIG. 9A), in order to accommodate and convey, for example, 35 mm and APS film.

Figure 22:
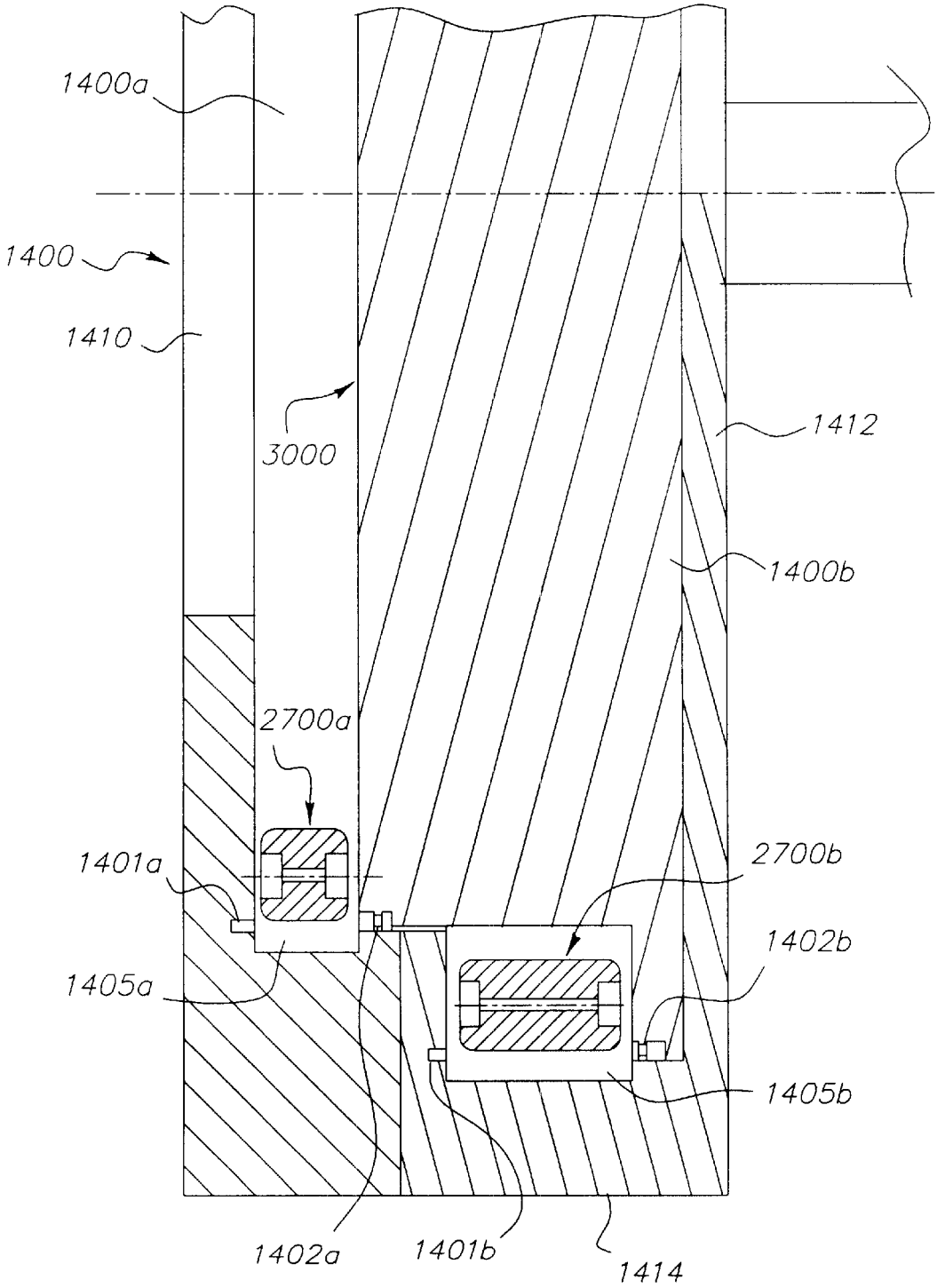
FIG. 22 illustrates a sectional view of further embodiment of the processing drum of the present invention.

FIG. 22 illustrates a further embodiment of a circular processing drum in accordance with the present invention. In the embodiment of FIG. 22, the rotatable disk is not movable along the axis of symmetry. That is, in the embodiment of FIG. 22, the disk is rotatable as in the previously described embodiment, however, the disk is configured and/or placed within the drum so as to enable the conveyance of at least two different types of film (i.e., APS and 35 mm film).

Referring now specifically to FIG. 22, a circular processing drum 1400 is shown in sectional view, Circular processing drum 1400 includes a first wall 1410, a second wall 1412 and a side wall 1414 which connects first wall 1410 to the second wall 1412, and extends around the perimeter of drum 1400. A disk 3000 is rotatably positioned inside drum 1400 in a plane parallel to both first wall 1410 and second wall 1412. Similar to disk 30 of FIGS. 9A and 13, disk 3000 includes disk teeth around a portion of a periphery thereof. However, rather than a single set of disk teeth, disk 3000 includes a first set of disk teeth 1402*a* and a second set of disk teeth 1402*b*.

Processing drum 1400 is generally divided into a first section 1400*a* which includes a first area or film passageway 1405*a* for processing a first type of film (for example, APS film), and a second section 1400*b* which includes a second area or film passageway 1405*b* for processing a second type of film (for example, 35 mm film) which is different from the first type of film.

With reference to first section 1400*a*, as illustrated in FIG. 22, first film passageway 1405*a* for processing the first type film, includes a roller 2700*a* similar to roller 27 of FIG. 7. However, roller 2700*a* is located at first area or film passageway 1405*a*. As also shown in FIG. 22, a groove 1401*a* is positioned in first section 1400*a*, such that during film conveyance, one side of the first type of film will fit within groove 1401*a*, while perforations or holes on the opposite side of the first type of film will be interengaged with disk teeth 1402*a*.

With reference to second section 1400*b* of drum 1400, a roller 2700*b* is located at second area or film passageway 1405*b*. A groove 1401*b* is positioned at second section 1400*a*, such that during film conveyance, one side of the second type of film will fit within groove 1401*b*, while holes or perforations on the opposite side of the second type of film will be interengaged with disk teeth 1402*b*.

Figure 23:
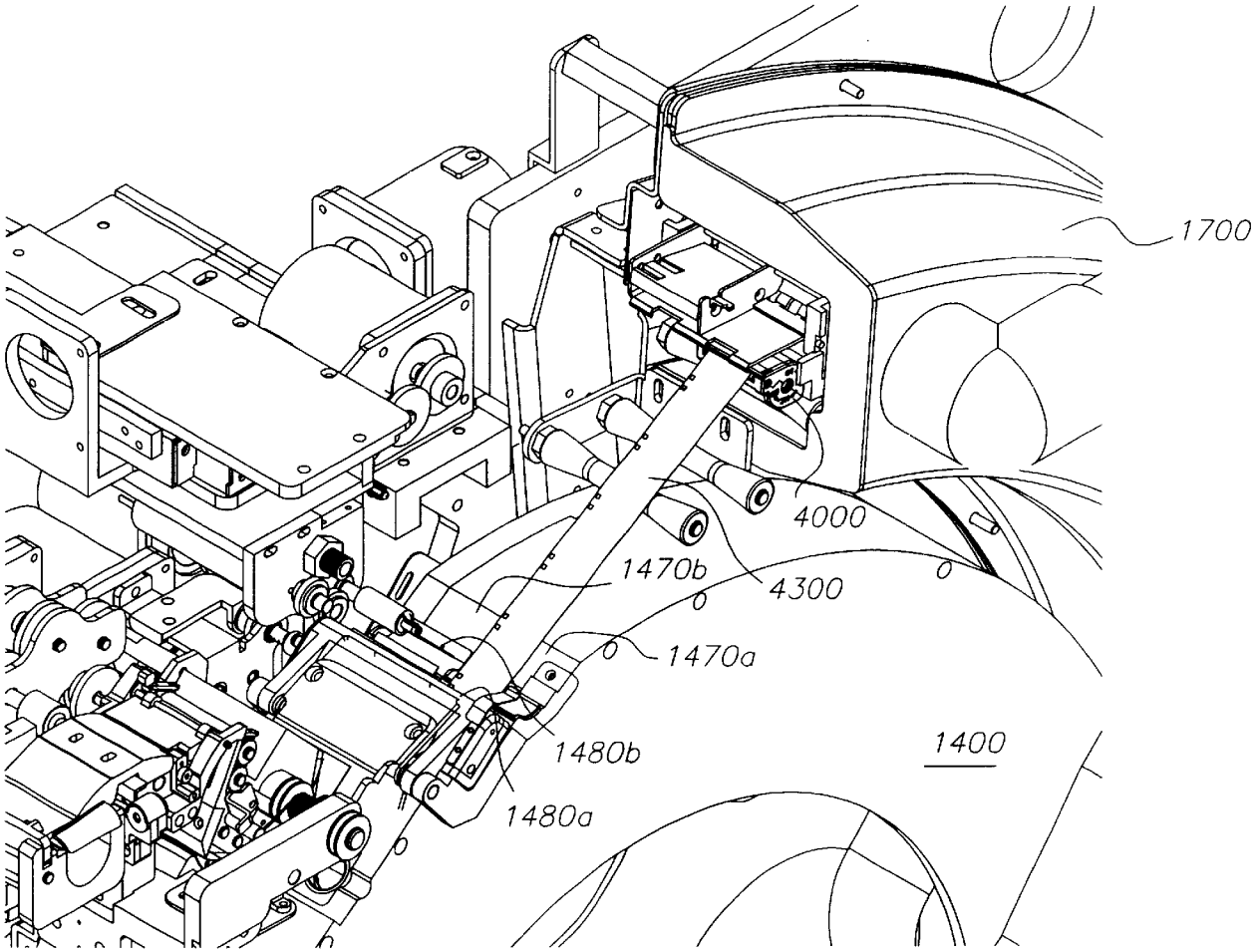
FIG. 23 is a partial view of the drum of FIG. 22, showing a first type of film being transferred from the drum to a dryer.

As shown in FIG. 23, circular processing drum 1400 is similar to processing drum 14 of FIG. 3, however, circular processing drum 1400 is in the form of a side by side arrangement that defines two circular processing paths 1405*a* and 1405*b* (FIG. 22) which are in respective adjacent parallel planes. As also shown in FIG. 23, circular processing drum 1400 comprises a first film cartridge loading area 1470*a* and a second film cartridge loading area 1470*b*.

With reference to first film cartridge loading area 1470*a*, similar to loading area 147 of processing drum 14, loading area 1470*a* permits a loading of a first type of film (APS film) directly from a film cartridge into circular processing drum 1400. Further, like film input slot 148 of circular processing drum 14, circular processing drum 1400 includes a film input slot 1480*a*, for permitting the entry and exit of the first type of film into and from circular processing drum 1400.

Therefore, when it is desired to process a first type of film, a film cartridge 4000 is positioned at film cartridge loading area 1470*a*. At this point, processing drum 1400 initiates a number of film/loading and conveying steps similar to the loading and conveying steps described in FIGS. 10–14. Within the context of the present invention, the preferable film for the first type of film is APS film.

More specifically, and with reference to FIG. 23, once a first type of film 4300 is introduced via input slot 1480*a*, film 4300 will travel within first processing area or processing path 1405*a*. More specifically, during the film loading steps, in the same manner as described with reference to processing drum 14, disk 3000 is controllably rotated so that disk teeth 1402*a* engages perforations or holes on one end of film 4300, while the other end of film 4300 will be positioned in groove 1401a. Film 4300 while in processing path 1405*a* will also pass between roller 2700*a* and an inner surface of drum 1400. Rotation of drum 1400 and disk 3000 in a manner similar to the rotation of drum 14 and disk 30 help to agitate the processing fluid in the vicinity of wheel 2700*a* to promote processing. Thus, the chemical processing steps for processing drum 1400 are similar to the processing steps of drum 14 as described with reference to FIGS. 10–14.

Following the chemical processing steps which is done in a manner similar to the previously described embodiment, film 4300 is removed from circular processing drum 1400 and exposed to a drying operation. The removal of film 4300 from processing drum 1400 is done a manner similar to the embodiment of FIG. 1 as shown in FIG. 15A. That is, FIG. 23 shows a state where cartridge 4000 has been removed from first film loading area 1470*a* by way of a film transfer assembly similar to film transfer assembly 60 described with reference to FIG. 15A, and placed at the entrance of a dryer 1700. Dryer 1700 is similar to dryer 17 of the first embodiment.

In the embodiment of FIGS. 22 and 23, film 4300 remains attached to film cartridge 4000 as with APS film, and the film transfer arm assembly (similar to the film transfer arm assembly 60 of FIG. 15A) will pull film cartridge 4000 from loading area 1470*a*, and film 4300 from circular processing drum 1400 through dryer 1700 which is sized to receive various types of film. Further, similar to the previous embodiment, once dried, film 4300 is rewound back into cartridge 4000 prior to proceeding to, for example, a scanner.

The above describes the processing of a first type of film, and preferably APS film within processing drum 1400.

If it is desired to process a second type of film such as 35 mm film within processing drum 1400, second film loading area 1470*b* and second film processing path 1405*b* is utilized. Since the second type of film is preferably 35 mm film, a film loading and unloading device as illustrated in FIGS. 16–18 is used. That is, a film loading and unloading device 15 as shown in FIG. 16 which extracts film from a second type of film cartridge, and more specifically a 35 mm film cartridge, and winds the film into a festoon box is used. The festoon box which is similar to festoon box 155 shown in FIG. 18 can be placed in a film loading position at film loading area 1470*a*, so as to introduce the second type of film into second film input slot 1480*b*. More specifically, the loading of the second type of film into processing drum 1400 via second loading area 1470*b* and input slot 1480*b* is similar to the loading method shown in FIGS. 16–18 for 35 mm film.

Figure 24:
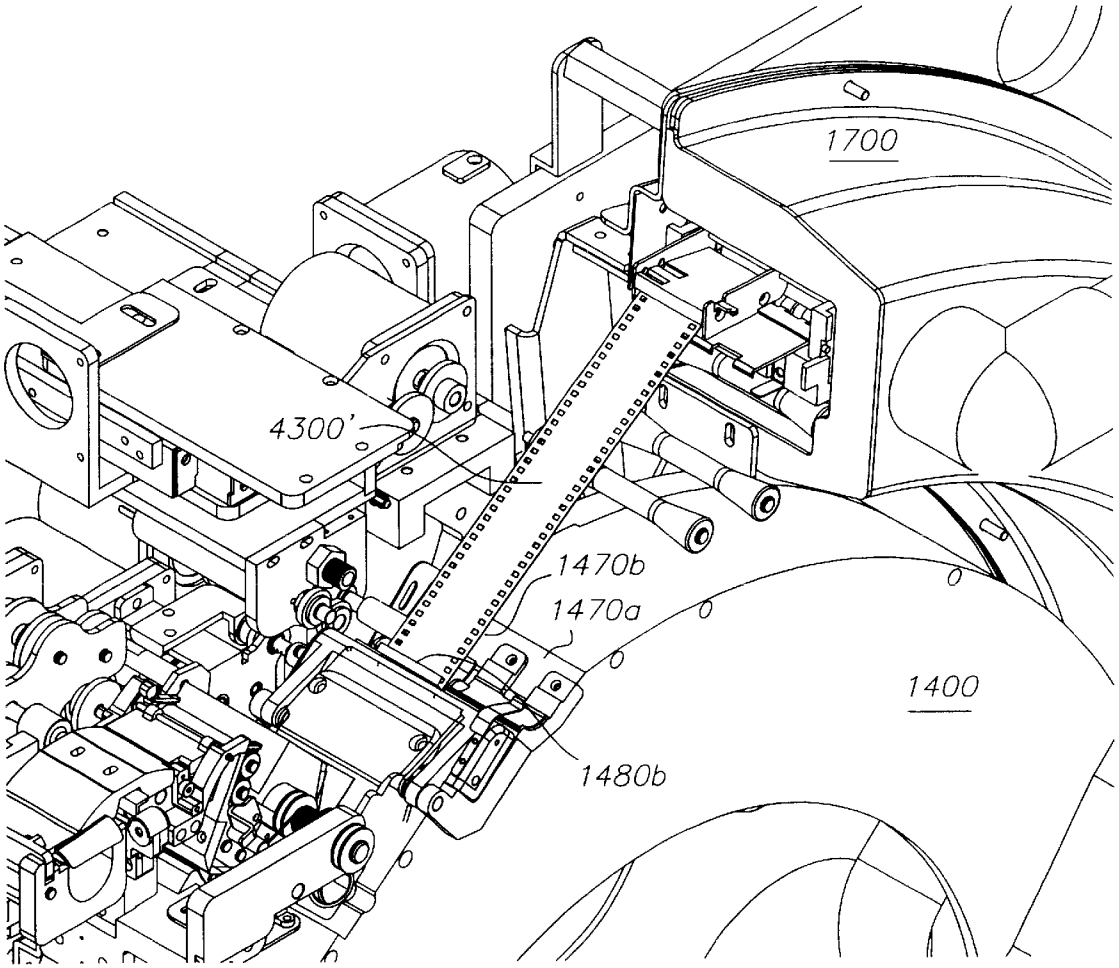
FIG. 24 is a partial view of the drum of FIG. 22 showing a second type of film being transferred from the drum to a dryer.

In the embodiment of FIGS. 22–24, the second type of film is conveyed into second film processing path or area 1405*b*, which is in a plane that is parallel to first processing path or area 1405*a*. Therefore, once introduced into slot 1480*b*, film 4300' (FIG. 24) travels through second film processing path 1405*b* and between roller 2700*b* and an inner surface of processing drum 1400 (FIG. 22). When introduced into slot 1480*a*, in a manner similar to the previously described embodiments, disk 3000 is controllably rotated so as to bring second disk teeth 1402*b* into engagement with perforations or holes on one side of second type of film 4300'. At the same time, the opposite side of second type of film 4300' travels through groove 1401*b*. Thereafter, the second type of film is positioned by way of the controlled rotation of disk 3000 in a similar manner to the previously described embodiments, and chemically processed by rotating the disk and drum simultaneously in a similar manner to the first embodiment.

Following the chemical processing steps, the second type of film is transferred to dryer 1700 by a transfer arm assembly similar to transfer arm assembly 60 described in FIGS. 15A–15B and 19. That is, as shown in FIG. 24, film 4300' is pulled from circular processing drum 1400 through film input slot 1480*b* by film sheet gripper rollers similar to film grip sheet gripper rollers 65 attached to an upper transfer arm as shown in FIG. 19. The film sheet gripper rollers, in a similar manner as shown in FIG. 19, essentially will pull second type of film 4300' through dryer 1700 and transfer the dried film into a scanner festoon box for further processing similar to the process described in FIGS. 19, 20 and 21.

Figure 25:
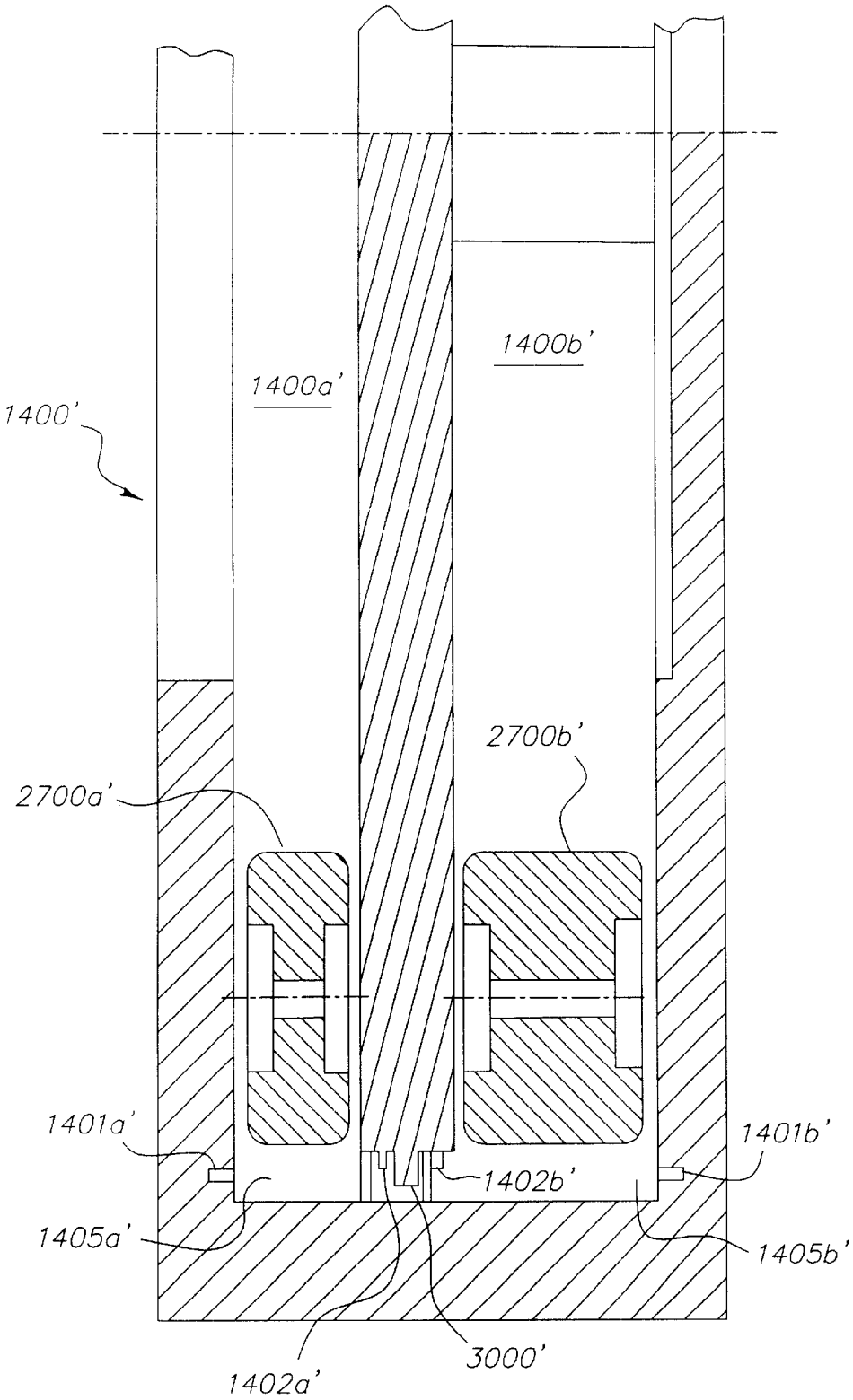
FIG. 25 illustrates a sectional view of a further embodiment of the processing drum of the present invention.

FIG. 25 illustrates a further embodiment of a processing drum in accordance with the present invention. The embodiment of FIG. 25 differs from the embodiment of FIG. 24 with respect to the structure of the disk. More specifically, processing drum 1400' of FIG. 25 includes a disk 3000' which is positioned substantially in a central location of drum 1400'. The placement of disk 3000' at the center of drum 1400', essentially divides drum 1400' into a first section 1400*a*' which includes a first processing path 1405*a*', and a second section 1400*b*' which includes a second processing path 1405*b*'. Each of the first and second processing paths 1405*a*' and 1405*b*' are circular processing paths which are respectively positioned in parallel planes. Like the first two embodiments, disk 3000' includes disk teeth around a portion of an outer periphery thereof. In the embodiment of FIG. 25, disk 3000' includes first disk teeth 1402*a*' on one side of disk 3000', and second disk teeth 1402*b*' on a second side of a disk 3000'.

The combination of first disk teeth 1402*a*' and a groove 1401*a*' in the vicinity of first processing path 1405*a*', are used to convey a first type of film along first processing path 1405*a*'. The combination of second disk teeth 1402*b*' and a groove 1401*b*' in the vicinity of second processing path 1405*b*',are used to convey a second type of film along second processing path 1405*b*'.

Drum 1400' further includes a first roller 2700*a*' located at first processing path 1405*a*' and a second roller 2700*b*' located at second processing path 1405*b*'. First and second rollers 2700*a*', 2700*b*' are on opposing sides of disk 3000'.

During use of processing drum 1400' of FIG. 25, when it is desired to process a first type of film such as APS film, the first type of film is loaded onto a loading area on the drum (see for example, loading area 1470*a* of drum 1400 of FIG. 24). Once the first type of film enters an input slot of the drum, the film catches the first set of disk teeth 1402*a*', and is guided within groove 1401*a*' in a manner similar to the previously described embodiments. Thereafter, the film is conveyed through first processing path 1405*a*', and passes between roller 2700*a*' and an inner surface of processing drum 1400' during processing. In the embodiment of FIG. 25, disk 3000' is controllably rotated with respect to and simultaneously with drum 1400' in the same manner as disk 30 and disk 3000 as previously described. After processing, the first type of film is removed and dried in a manner similar to the film drying process as described with reference to processing drum 1400 and processing drum 1400'.

When it is desired to process a second type of film such as 35 mm film, the second type of film is introduced into a second input slot of the drum as described and shown in, for example, FIG. 23. Once introduced into second film processing path 1405*b*',the perforations or holes on the second type of film are interengaged with disk teeth 1402*b*', while the other side of the film travels within groove 1401*b*'. Thereafter, disk 3000' is controllably rotated with respect to and simultaneously with processing drum 1400' in the same manner as described with respect to processing drums 14 and 1400'. As the film is conveyed through processing drum 1400', it is passed between roller 2700*b*' and the inner surface of processing drum 1400', which enhances the agitating effect of the processing solution for processing.

Thereafter, the second type of film is removed and dried in a similar manner as described with reference to processing drum 14 and processing drum 1400'.

Therefore, with reference to the embodiments of FIGS. 22 and 25, circular disks 3000 and 3000' are each designed to transport both first and second types of film, such as for example APS and 35 mm film, without having to be shifted along a rotational axis of the disk. Disk 30 of the first embodiment includes a shifting member to accommodate 35 mm and APS film.

Also, with the arrangement of FIGS. 22 and 25 with respect to disks 3000 and 3000', it is assured that the exact or appropriate amount or volume of chemistry or processing solution will be used for processing APS film and 35 mm film. That is, by having first and second processing paths with the combination of disk 3000 or disk 3000' as shown, it is possible to supply the exact amount of solution when processing APS film in the APS processing path and when processing 35 mm film in the 35 mm processing path. For example and with reference to FIG. 22, it is noted that disk teeth 1402*a* are closer to the rotational axis of disk 3000 than disk teeth 1402*b*. This feature in combination with the positioning and size of disk 3000 defines a first volume for processing path 1403*a* and a second volume for processing path 1403*b* which can be designed to match the exact or appropriate volume of solution needed for processing APS film and 35 mm film. The embodiment of FIG. 23, like FIG. 22, also permits the exact or appropriate volume of solution for each type of film to be used. That is, as shown in FIG. 23, the placement of disk 3000' forms path 1405*a*' which defines a first volume for receiving solution to process APS film, and path 1405*b*' which defines a second volume for receiving solution to process 35 mm film.

Further, in the embodiment of FIG. 22, disk 3000 is basically a solid body which extends from wall 1412 to an area approximately at the center of the processing drum. Disk 3000 is thus substantially positioned at one of the processing paths. In the example shown, disk 3000 is substantially positioned at second processing path 1405*b*. Because of the area taken up by disk 3000, a minimum amount of processing solution is utilized in such an arrangement. In the embodiment of FIG. 22, disk teeth 1402*a* are provided at a first edge portion of the drum and are located within or adjacent to first processing path 1405*a* of the drum; while disk teeth 1402*b* are located along a second edge portion of the drum and are located within or adjacent to second processing path 1405*b* of the drum. Also, disk teeth 1402*a* are positioned closer to a rotational axis of disk 3000 than disk teeth 1402*b*.

In the embodiment of FIG. 25, disk 3000' which can also be a solid body is positioned approximately at a central area of the processing drum so as to divide the processing drum into a first area 1400*a*' and a second area 1400*b*'.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

The invention has been described in detail with particular reference to certain preferred embodiments thereof, but it will be understood that variations and modifications can be effected within the spirit and scope of the invention.

What is claimed is:

1. A photographic processor comprising:

a processing drum having a first wall, a second wall, and a side wall connecting the first wall to the second wall, said side wall extending around a perimeter of the drum;

a disk positioned inside the drum in a plane parallel to both the first wall and the second wall, wherein the disk comprises a first set of disk teeth capable of interengaging with first holes along an edge of a first type of film, and a second set of disk teeth capable of interengaging with second holes along an edge of a second type of film; and a mechanism for rotating the disk.

2. A photographic processor according to claim 1, wherein said mechanism is adapted to rotate the disk while the drum is stationary.

3. A photographic processor according to claim 1, wherein said mechanism is adapted to rotate the disk and the drum simultaneously.

4. A photographic processor according to claim 1, wherein said disk is positioned adjacent to one of said first or second walls.

5. A photographic processor according to claim 4, wherein said disk comprises a solid body which extends from said one of said first or second walls to an area approximately at a center of said processing drum.

6. A photographic processor according to claim 1, wherein said disk is positioned approximately in a central area of said processing drum.

7. A photographic processor according to claim 1, wherein said processing drum comprises a first area which includes a first processing path where said first type of film is processed, and a second area which includes a second processing path where said second type of film is processed, said first area defining a first volume sized to receive an appropriate amount of processing solution to process the first type of film, and said second area defining a second volume sized to receive an appropriate amount of processing solution to process the second type of film.

8. A photographic processor according to claim 7, wherein said disk is substantially positioned in one of said first or second areas.

9. A photographic processor according to claim 7, wherein said disk is positioned between said first and second areas.

10. A photographic processor according to claim 7, wherein said disk includes a first edge portion located within or adjacent to said first area of the processing drum, said first set of disk teeth being positioned along said first edge portion of said disk to convey film along the first processing path, said disk further including a second edge portion located within or adjacent to said second area of the processing drum, said second set of disk teeth being positioned along the second edge portion of said disk to convey film along the second processing path.

11. A photographic processor according to claim 1, wherein one of said first or second set of disk teeth is positioned radially closer to a rotational axis of said processing drum that the other of said first or second set of disk teeth.

12. A photographic processor according to claim 1, wherein said first type of film is at least APS film and said second type of film is at least 35 mm film.

13. A photographic processor according to claim 1, wherein said processing drum comprises a first input section for introducing the first type of film into a first film path in the processing drum, and a second input section for introducing the second type of film into a second film path in the processing drum.

14. A photographic processor according to claim 13, wherein said first and second film paths are circular film paths which are respectively positioned within adjacent parallel planes.

15. A processing device comprising:

means for processing a first type of film along a first circular processing path and processing a second type of film along a second circular processing path, wherein said first and second circular processing paths are respectively positioned within adjacent parallel planes; and means for conveying the first and second types film along the respective first and second circular processing paths.

16. A processing apparatus comprising:

a circular processing drum having a first film path for processing a first type of film and a second film path for processing a second type of film, said first and second film paths being respectively positioned in parallel planes; and a circular disk positioned inside the drum, said disk comprising a first set of disk teeth capable of interengaging with first holes on the first type of film to convey the first type of film along the first film path, and a second set of disk teeth capable of interengaging with second holes on the second type of film to convey the second type of film along the second film path.

17. A processing apparatus according to claim 16, wherein the first type of film is at least APS film and the second type of film is at least 35 mm film.

18. A method of processing photographic film, the method comprising the steps of:

inserting the film into a first processing path or a second processing path of a circular processing drum based on a type of film to be processed, said first processing path being adapted to receive a first type of film and said second processing path being adapted to receive a second type of film which is different from said first type of film;

supplying and discharging processing solution into and from said processing drum to process said film; and transferring the processed film from the circular processing drum to a circular drying cylinder.

19. A method according to claim 18, wherein said first type of film is at least APS film and said second type of film is at least 35 mm film.

* * * * *